US006005245A

United States Patent [19]

Sakairi et al.

[11] Patent Number: 6,005,245

[45] **Date of Patent: *Dec. 21, 1999**

[54] METHOD AND APPARATUS FOR IONIZING A SAMPLE UNDER ATMOSPHERIC PRESSURE AND SELECTIVELY INTRODUCING IONS INTO A MASS ANALYSIS REGION

[75] Inventors: Minoru Sakairi, Kawagoe; Tadao Mimura, Hitachinaka; Yasuaki Takada; Takayuki Nabeshima, both of Kokubunji; Hideaki Koizumi, Tokyo, all of Japan

[73] Assignee: Hitachi, Ltd., Tokyo, Japan

[ * ] Notice: This patent is subject to a terminal disclaimer.

[21] Appl. No.: 08/919,785

[22] Filed: Aug. 29, 1997

Related U.S. Application Data

[63] Continuation of application No. 08/555,192, Nov. 8, 1995, Pat. No. 5,663,560, which is a continuation-in-part of application No. 08/302,555, Sep. 8, 1994, Pat. No. 5,481,107.

[30] Foreign Application Priority Data

Sep. 20, 1993 [JP] Japan ..... 5-232833
Oct. 27, 1995 [JP] Japan ..... 7-280159

[51] Int. Cl.[6] ..... H01J 49/06

[52] U.S. Cl. ..... 250/281; 250/288

[58] Field of Search ..... 250/281, 288, 250/288 A

[56] References Cited

U.S. PATENT DOCUMENTS

| | | | |
|---|---|---|---|
| 4,746,794 | 5/1988 | French et al. | 250/288 |
| 4,999,492 | 3/1991 | Nakagawa | 250/281 |
| 5,376,791 | 12/1994 | Swanson et al. | 250/309 |
| 5,426,301 | 6/1995 | Turner | 250/288 |
| 5,481,107 | 1/1996 | Takada et al. | 250/281 |

*Primary Examiner*—Jack I. Berman
*Attorney, Agent, or Firm*—Kenyon & Kenyon

[57] ABSTRACT

A method in which cutting of small droplets, neutral particles or photons through to a slit provided between a differential pumping portion and a mass analysis portion is combined with slight deflection of ions just before introduction of the ions into the mass analysis portion so that noises are greatly reduced without reduction of signals to thereby improve the signal-to-noise ratio which is an index of detecting sensitivity or lower limit.

23 Claims, 26 Drawing Sheets

A : ACCUMULATING IONS
B : COOLING IONS
C : SCANNING

METHOD AND APPARATUS FOR IONIZING A SAMPLE UNDER ATMOSPHERIC PRESSURE AND SELECTIVELY INTRODUCING IONS INTO A MASS ANALYSIS REGION

This is a continuation of application Ser. No. 08/555,192 filed on Nov. 8, 1995, now U.S. Pat. No. 5,663,560, which is a continuation-in-part of Ser. No. 08/302,555, filed Sep. 8, 1994, now U.S. Pat. No. 5,481,107.

BACKGROUND OF THE INVENTION

The present invention relates to an ionization method or ion source for ionizing a matter contained in a solution under atmospheric pressure or similar pressure and a mass spectrometry or mass spectrometer using the ionization method or ion source, and also relates to a liquid chromatograph/mass spectrometer, a capillary electrophoresis system/mass spectrometer and a plasma mass spectrometer.

As the related art, three techniques may be taken as examples as follows.

The first one of the examples of the related is a method used in a plasma mass spectrometer, as disclosed in JP-A-2-248854 (U.S. Pat. No. 4,999,492). FIG. 16 is a reference view showing the method. In the method, ions generated by inductively coupled plasma are introduced into a high vacuum through a differential evacuation portion. In this occasion, in order to reduce noises due to high-speed neutral particles and photons mainly generated by plasma, ions extracted by an ion extraction lens 19 through an ion taken-out aperture 7 of the differential evacuation portion are deflected by a deflector 20 and introduced into a mass analysis portion 13 through an ion take-in aperture 12 so that the high-speed neutral particles and photons going straight are cut partially.

The second example of the related art is the technique which is disclosed in JP-A-7-85834. FIG. 17 is a reference view showing the technique. The technique is adapted not only to a plasma mass spectrometer but also to a liquid chromatograph/mass spectrometer using a mass spectrometer as a detector of a liquid chromatograph to separate a mixture sample in solution, and a capillary electrophoresis system/mass spectrometer using a mass spectrometer as a detector of a capillary electrophoresis system to separate a mixture sample in solution. In this occasion, noises in the detector is mainly caused not by high-speed neutral particles and photons but by small droplets flowing into a high vacuum through a differential evacuation portion. In the case of a liquid chromatograph/mass spectrometer or a capillary electrophoresis system/mass spectrometer, there is employed a method in which electrically charged droplets are basically generated by spraying a solution and solvent molecules are vaporized from the electrically charged droplets to thereby generate ions of sample molecules. Accordingly, the electrically charged droplets thus generated are not always vaporized thoroughly, so that small droplets which are not vaporized remain inevitably. The not-vaporized small droplets flow into the high vacuum through the differential evacuation portion and reach the detector to cause bit noises. In this technique, a double-cylindrical electrostatic lens is used as an electrostatic lens for deflecting and focusing ions. In this occasion, a large number of apertures are opened in an inner cylindrical electrode 10, so that ions are deflected and focuses by using an electric field coming from the apertures of the inner cylindrical electrode 10 by the change of the voltage between the inner cylindrical electrode 10 and an outer cylindrical electrode 11 to thereby remove the small droplets, or the like, as the cause of noises.

The third example of the related art is the technique which is a method described in EP-A-0237249. FIG. 18 is a reference view showing the method. In the method, three quadrupole sets employing a high-frequency electric field are used. A first quadrupole set 26 has a function for mass-analyzing or focusing ions generated by an ion source 24 and focused by a lens 25. A second quadrupole set 27 is bent with a certain curvature. A detector 14 is disposed in the rear of a third quadrupole set 28 which has a function for mass-analyzing ions. Because the second quadrupole set 27 is bent with a certain curvature, ions having electric charges pass through the curved quadrupole set but neutral particles and droplets having no electric charges go straight. Accordingly, the neutral particles and droplets do not reach the detector 14 disposed in the rear of the third quadrupole set 28 for mass-analyzing ions, so that the noise level in the detector 14 is reduced correspondingly.

In the above first example, if the quantity of ion deflection is increased, the flowing of neutral particles, photons, etc. into the mass analysis portion can be prevented correspondingly securely so that the noise level in the detector can be reduced correspondingly. If the quantity of ion deflection is increases, however, it becomes correspondingly difficult to focus ions again at the ion take-in aperture 12 of the mass analysis portion after deflection of ions. This is because the ion beam is widened at the ion take-in aperture 12 of the mass analysis portion or the angle of ions incident to the ion take-in aperture 12 of the mass analysis portion is increased. If the focus condition at the ion take-in aperture 12 of the mass analysis portion is poor, the ion transmission efficiency through the mass analysis portion becomes low so that the ion intensity of a sample to be measured, that is, the signal intensity is lowered. Accordingly, in the method, the signal intensity is reduced simultaneously with the reduction of noises even in the case where noises caused by high-speed neutral particles or photons is reduced by high ion deflection, so that it is finally impossible to improve greatly the signal-to-noise ratio as an index of detecting sensitivity.

Although the above description has shown the case where a quadrupole mass spectrometer is used as the mass spectrometer, this problem will become more serious when a special mass spectrometer such as an ion trap mass spectrometer, or the like, is used in the first example of the related art. In the case of a quadrupole mass spectrometer, the ion take-in aperture 12 of the mass analysis portion has a relatively large diameter of about 3 mm. Accordingly, even in the case where the focus condition at the ion take-in aperture 12 of the mass analysis portion is poor, that is, the ion beam is spread at the ion take-in aperture 12 of the mass analysis portion, the transmission efficiency of ions is not so greatly reduced. In the case of an ion trap mass spectrometer of the type in which ions are enclosed in a region surrounded by a pair of an end cap electrode and a ring electrode, however, the ion take-in aperture provided in the end cap electrode cannot be made so large because the disturbance of a high-frequency electric field in the inside cannot be made so large. Generally, the diameter of the ion take-in aperture in the case of an ion trap mass spectrometer is about 1.3 mm, which is smaller than that in the case of a quadrupole mass spectrometer. Accordingly, in the case of an ion trap mass spectrometer, it has been confirmed that the lowering of the transmission efficiency of ions becomes remarkable if the ion beam is spread at the ion take-in aperture when ions are deflected in the manner as described above.

Also in the second example of the related art, the signal intensity is reduced simultaneously with the reduction of noises even in the case where ions are deflected greatly to reduce noises caused by droplets and neutral particles, the signal-to-noise ratio as an index of detecting sensitivity finally cannot be improved greatly.

In the third example of the related art, the apparatus becomes not only very complex but also very expensive. The quadrupole sets are required to be mechanically finished with accuracy of the order of microns, and the electrodes in the second quadrupole set are required to be bent with a certain curvature. Furthermore, a high-frequency electric source must be used in the quadrupole sets. Particularly in the case where electrodes in the second quadrupole set are bent with a large curvature in order to reduce noises greatly, there arises a serious problem in machining.

SUMMARY OF THE INVENTION

The present invention solves the aforementioned problems by providing an apparatus for mass analysis which comprises: a sample supply unit for supplying a sample in solution; an atomizer for atomizing the sample solution; an ion source for ionizing a predetermined matter in the atomized sample solution to thereby form a particle stream constituted by electrically charged particles and neutral particles; a differential evacuation portion including an aperture for leading the particle stream to a vacuum analysis portion, and an electric source for applying a voltage to the aperture; a focusing lens for focusing the electrically charged particles contained in the particle stream; a deflector for deflecting the electrically charged particles; a mass spectrometer for measuring the value of mass-to-charge ratio of the charged particles; and a limit plate for limiting the flow path of the particle stream, the limit plate being provided between the focusing lens and the mass spectrometer.

More in detail, it is only necessary that small droplets, neutral particles or photons (which concern only the case of a plasma mass spectrometer) as the cause of noises in a detector are cut efficiently from the particle stream constituted by electrically charged particles and electrically neutral particles, inclusive of droplets, solvent molecules, atmospheric gas molecules and ions, without so much increasing the quantity of ion deflection before ions are introduced into the mass analysis portion which estimates a value of mass-to-charge ratio of charged particles. To this end, ions extracted through an ion take-out aperture of the differential evacuation portion are once focused by the focusing lens in the condition in which a limit plate, that is, a slit for cutting a large part of droplets, neutral particles or photons (which concern only the case of a plasma mass spectrometer) as the cause of noises is placed on the focal point of the focusing lens. In this manner, ions pass through the slit efficiently because ions are focused at the position of the slit, whereas a large part of small droplets, neutral particles or photons (which concern only the case of a plasma mass spectrometer) are cut efficiently at this slit portion because such small droplets, neutral particles or photons which are not affected or focused by an electric field are spread spatially after passing through an ion take-out aperture of the differential evacuation portion. That is, ions are deflected so as to be introduced into the mass analysis portion after passing through the slit, whereas small droplets, neutral particles or photons (which concern only the case of a plasma mass spectrometer) a large part of which have been cut at the slit position go straight and collide with the wall of the mass analysis portion so as to be withdrawn. Further, with such a configuration, the object of the present invention can be achieved by a simple and inexpensive configuration without requiring any complicated configuration.

In short, the method of the related art attempts to improve the signal-to-noise ratio merely by deflecting ions greatly, whereas the present invention attempts to greatly improve the signal-to-noise ratio by combining cutting of small droplets, neutral particles or photons through a slit and slight deflection of ions.

Among droplets as the cause of noises, there are droplets electrically charged. These electrically charged droplets have a very large mass compared with ions analyzable in the mass analysis portion, so that these electrically charged droplets obtain large kinetic energy corresponding to the streaming thereof when the droplets flow into a vacuum through the aperture. The orbit of these electrically charged droplets is bent by an electrostatic lens but the quantity of deflection of the orbit thereof is relatively small compared with the quantity of deflection of the orbit of ions. Accordingly, because the position of ions focused by the electrostatic lens is different from the position of electrically charged droplets focused by the electrostatic lens, a large part of electrically charged droplets can be removed when a slit is disposed in the neighborhood of the position of ion focus.

DESCRIPTION OF THE PREFERRED EMBODIMENTS

Figure 1:
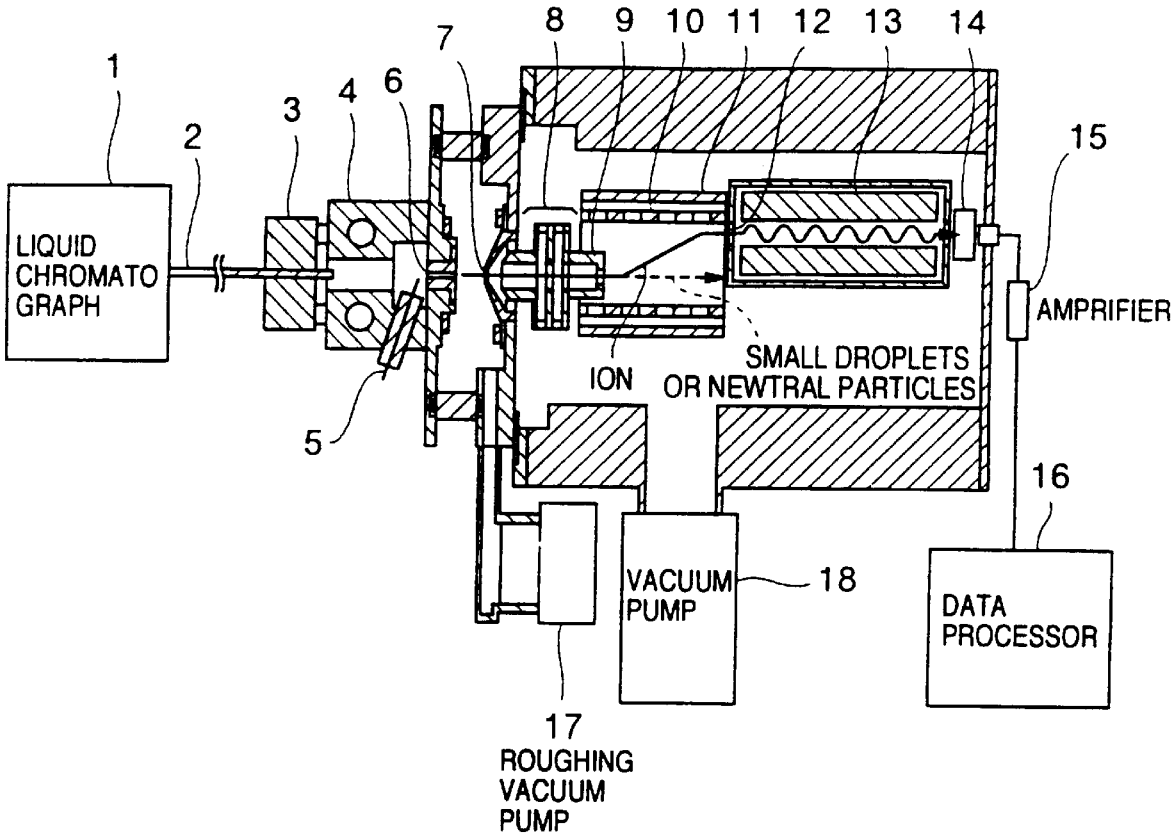
FIG. 1 is a structural view of an apparatus showing an embodiment of the present invention.
Figure 2:
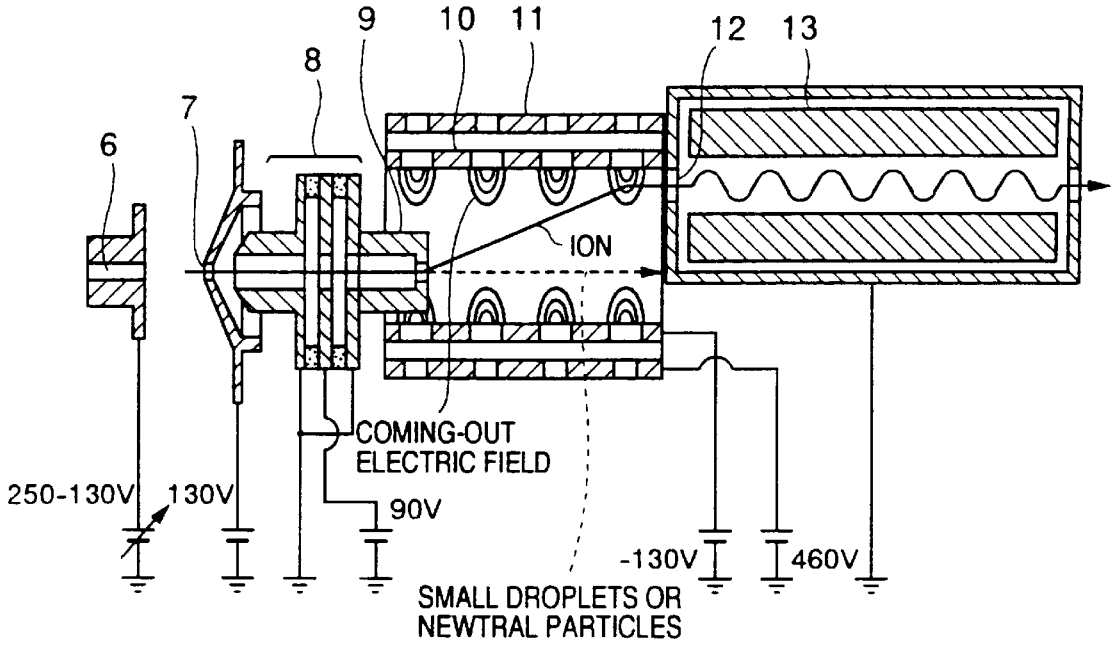
FIG. 2 is an enlarged view of a slit portion.

Referring to FIG. 1, there is shown an embodiment of a liquid chromatograph/mass spectrometer using a so-called atmospheric pressure chemical ionization method which is a kind of atmospheric pressure ionizing method in which ions are generated under atmospheric pressure or similar pressure. FIG. 2 is an enlarged view of a portion having a slit 9 which is the point of the present invention for reference. Not only the same discussion can be applied to the case where another atmospheric pressure ionization method (such as an electrospray in which electrically charged droplets are generated by electrostatic spraying, an atmospheric pressure spraying method in which electrically charged droplets are generated by heat spraying, sonic spray method in which electrically charged droplets are generated by using a sonic-speed gas, or the like) is used but also the same effect can be expected in a capillary electrophoresis system/mass spectrometer.

A sample in a solution separated by a liquid chromatograph 1 passes through a pipe 2 so that the sample solution is first nebulized by an nebulizer 3. Nebulizer 3 nebulizes the sample solution by heat spraying or gas spraying. Then, the nebulized sample solution is introduced into a vaporizer 4 which is heated up to a temperature in the range of from about 100 to 500° C. so that the nebulized sample solution is further vaporized. The thus generated small droplets and molecules are introduced into a region of corona discharge generated by applying a high voltage to a pointed end of a needle electrode 5. In this region, ions containing electrically charged droplets are generated by corona discharge followed by an ion molecule reaction.

The ions containing electrically charged droplets pass through an ion take-in aperture 6 (aperture diameter: about 0.25 mm, length: about 20 mm) in a differential pumping portion which is heated to a temperature in the range of from 50 to 150° C., and then the ions are introduced into the differential pumping portion. Then, after passing through the differential pumping region, ions are extracted by an electrostatic lens 8 through an ion take-out aperture 7 (aperture diameter: about 0.2 mm, length: about 0.5 mm) of the differential pumping portion. This region is generally evacuated from 10 to 0.1 Torr by a roughing vacuum pump 17. Another electrode having an aperture provided between the ion take-in aperture 6 of the differential pumping portion and the ion take-out aperture 7 of the differential pumping portion may be provided in the differential pumping portion. This is because an ultrasonic-speed streaming region (in which there is no collision between molecules, so that the temperature is reduced correspondingly) which is generated when ions flow into the differential pumping portion through the ion take-in aperture of the differential pumping portion is compressed so that the efficiency of vaporizing droplets flowing into the differential pumping portion is prevented from being lowered.

Figure 3A:
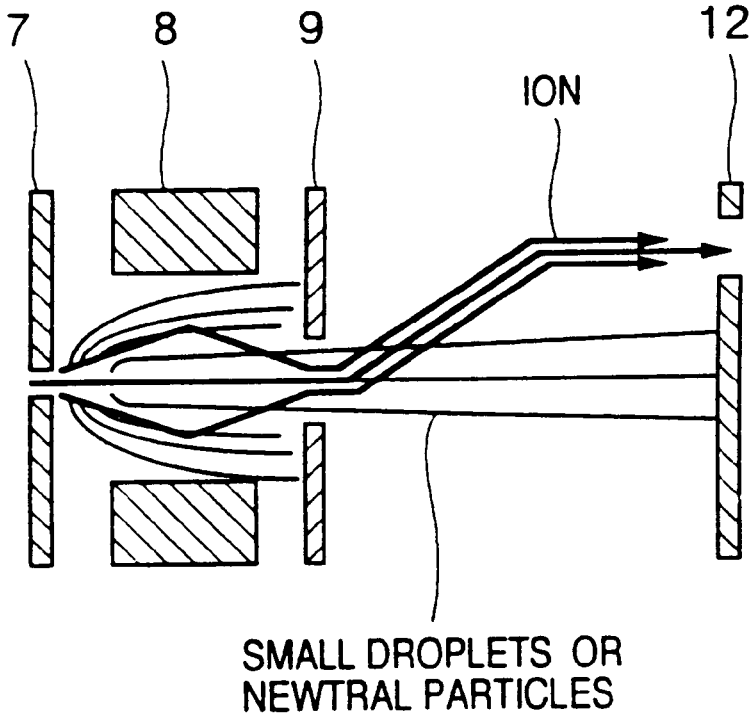
FIGS. 3A and 3B are conceptual views for explaining the meaning of the slit.
Figure 3B:
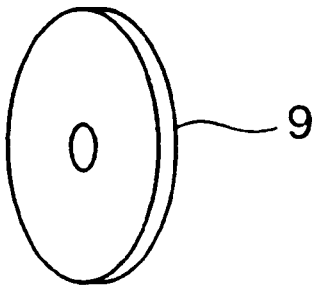

FIG. 2 is an enlarged view showing a range of from the ion take-in aperture 6 of the differential pumping portion to a quadrupole mass analysis portion. Generally, a voltage is applied between the ion take-in aperture 6 of the differential pumping portion and the ion take-out aperture 7 for the double purposes of improving ion transmission efficiency and generating desolvated ions. Ions extracted through the ion take-out aperture 7 of the differential pumping portion are once focused by the electrostatic lens 8. FIG. 1 shows the case where an Einzel lens which is a very popular electrostatic lens is provided as an example of the electrostatic lens 8. This lens is composed of three electrodes. Among the three electrodes, two electrodes opposite to each other have the same electric potential and one electrode located in the center has an electric potential which is changed to thereby change the focal length of ions. Hoes having the same diameter (in this system, about 7 mm holes) are provided in the neighborhood of the center axis of the three electrodes, so that ions pass through this hole portion. In the Einzel lens herein used, the electrode located in the ion take-out aperture 7 side of the differential pumping portion has a projected shape for the purpose of improving the efficiency of extraction of ions through the ion take-out aperture 7 of the differential pumping portion. In the electrode opposite to the Einzel lens, a slit 9 for narrowing small droplets and neutral particles flowing thereinto simultaneously with ions through the ion take-out aperture of the differential pumping portion is provided in the position of the focal point of the lens. This slit 9 is obtained by forming a hole having a diameter of about 2 mm in the center. A large part of small droplets and neutral particles flowing into the lens through the ion take-out aperture of the differential pumping portion and spread spatially are cut so that the small droplets and neutral particles are prevented as efficiently as possible from flowing into the mass analysis portion side. Considering the focusing condition, the diameter of the slit 9 is preferably selected to be in a range of from about 0.5 mm to about 5 mm so as to be smaller than the center diameter of the electrostatic lens 8. As shown in the conceptual view of FIGS. 3A and 3B, the slit 9 has a function of cutting neutral small droplets and neutral particles but there is no risk of reduction of ion transmission efficiency due to the provision of the slit 9 if the focal length of the electrostatic lens 8 provided in front of the slit 9 is changed so that ions are focused at the position of the slit by the electrostatic lens 8. In this occasion, if the aperture size of the slit 9 is not smaller than the aperture size of the electrostatic lens 8 provided in front of the slit 9, there is no meaning of the slit. That is, the important meaning of the present invention is in that small droplets and neutral particles are reduced in a stage in which ions are extracted through the ion take-out aperture 7 of the differential pumping portion and focused by the electrostatic lens 8. If the aperture size of the electrostatic lens 8 is reduced to 2 mm so that the electrostatic lens 8 can serve also as a function of reducing small droplets and neutral particles, ions are eliminated by collision with the wall of the electrostatic lens 8 to thereby greatly reduce ion transmission efficiency to make it difficult finally to improve the signal-to-noise ratio greatly because ions are not focused at the portion of the electrostatic lens 8. If small droplets and neutral particles are narrowed just after the ion take-out aperture 7 of the differential pumping portion, small droplets and neutral particles may be spread spatially again so as to flow into the ion take-in aperture 12 of the mass analysis portion in the case where the distance between the ion take-out aperture 7 of the differential pumping portion and the ion take-in aperture 12 of the mass analysis portion is large. It is most effective that small droplets and neutral particles as the cause of noises are narrowed just before deflection of ions. Therefore, the slit 9 may be provided so as to be added to the focusing lens 8 as shown in FIG. 2 or may be provided in the inside of the electrostatic lens (or deflector) for deflecting ions.

Preferably, the slit 9 is an electrical conductor such as a metal, or the like, and the electric potential thereof is kept in a predetermined value. This is because the change of the electric potential of the slit 9 has influence on the orbit of ions. Accordingly, though not shown, the slit 9 is connected to the ground or an electric source. The electric potential of the slit 9 is kept in a value allowing ions to pass through the slit 9, that is, the electric potential of the slit 9 is kept lower than the electric potential of the ion take-out aperture 7 of the differential pumping portion for analysis of positive ions or kept higher than the electric potential of the ion take-out aperture 7 for analysis of negative ions.

Figure 4A:
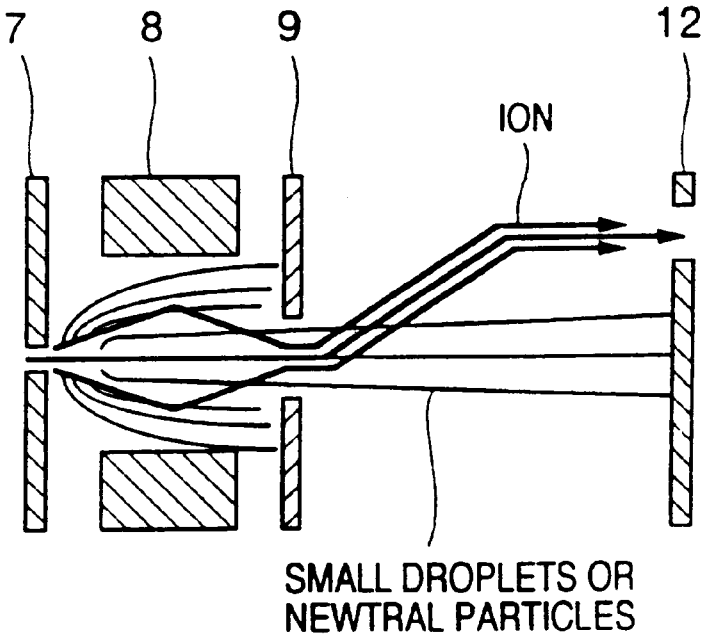
FIGS. 4A and 4B are conceptual views for explaining the meaning of the slit.
Figure 4B:
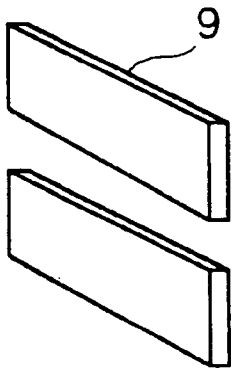
Figure 5A:
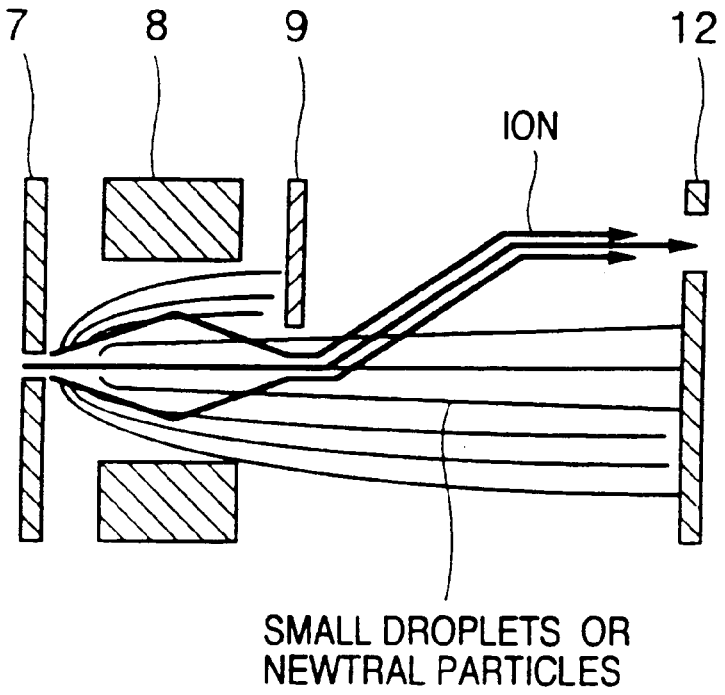
FIGS. 5A and 5B are conceptual views for explaining the meaning of the slit.
Figure 5B:
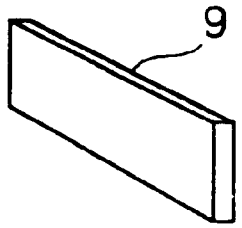

Although the above description has been made upon the case where a plate having a circular hole is used for cutting droplets and neutral particles as the cause of noises, the same effect as described above arises also in the case where two plates are arranged as shown in FIGS. 4A and 4B or in the case where a plate is arranged in the deflecting side as shown in FIGS. 5A and 5B.

Figure 6:
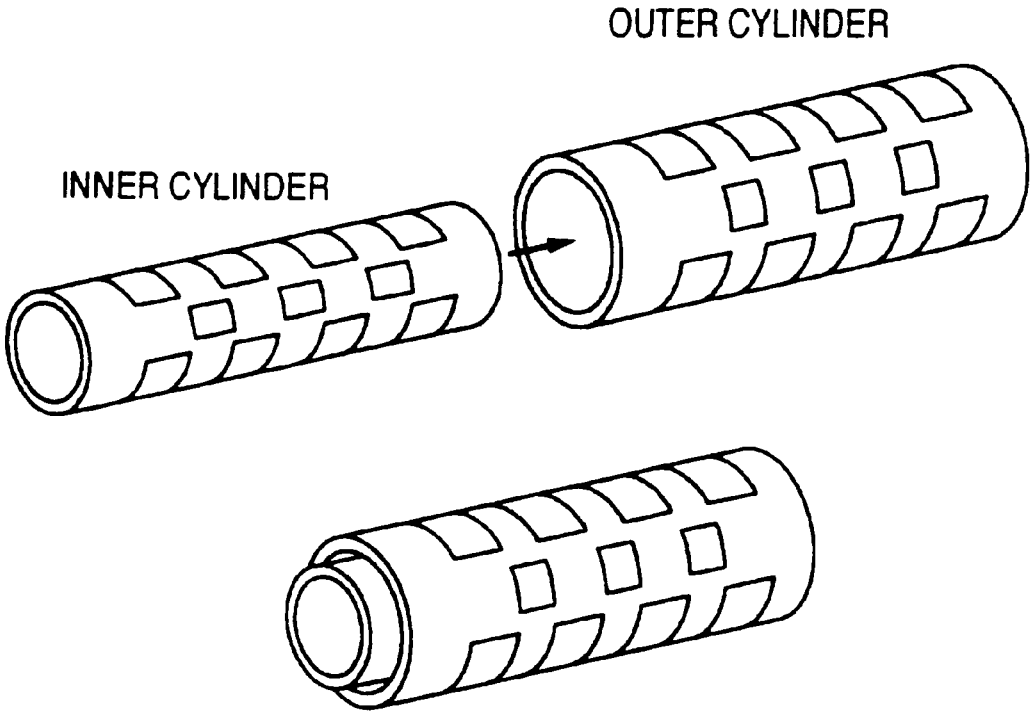
FIG. 6 is a schematic view of a double-cylindrical electrostatic lens.

Ions which have passed through the slit 9 enter a double-cylindrical electrostatic lens having an inner cylindrical electrode 10 and an outer cylindrical electrode 11 each of which is provided with a large number of aperture portions (see FIG. 6). The electrostatic lens has a function of focusing ions simultaneously with deflection of ions and then introducing ions into the mass analysis portion. With respect to the sizes of the cylindrical electrodes in FIG. 1, the inner cylindrical electrode 10 has a length of about 100 mm and an inner diameter of about 18 mm (provided with three or four alignments of openings arranged so as to be in phase by 90°, each alignment containing four openings, each opening having a width of about 10 mm) and the outer cylindrical electrode 11 has a length of about 100 mm and an inner diameter of about 22 mm. In this occasion, the outer cylindrical electrode 11 is provided with a large number of evacuation aperture portions for evacuating the inside of an ion guide sufficiently. Ions deflected by about 4 mm with respect to the center axis of the ion take-out aperture 7 of the differential pumping portion are introduced into the mass analysis portion through the ion take-in aperture 12 of the mass analysis portion so as to be mass-analyzed and detected. FIG. 1 shows the case where a quadrupole mass analysis portion 13 is used. In such a detector, a voltage higher than the voltage applied to the inner cylindrical electrode is applied to the outer cylindrical electrode so that deflection is performed by using an electric field generated through the aperture portions of the inner cylindrical electrode.

FIG. 2 shows an example of voltage application in a region of from the ion take-in aperture 6 to the quadrupole mass analysis portion. In the case of measurement of positive ions, a voltage in a range of from 130 to 250 V is applied to the ion take-in aperture 6, a fixed voltage of 130 V is applied to the ion take-out aperture 7, and voltages of 0 V, 90 V and 0 V are applied to the three electrodes of the electrostatic lens 8 in the order from left to right in the drawing. At this time, voltages of 460 V and −130 V are applied respectively to the outer cylindrical electrode and the inner cylindrical electrode which act to perform deflection. A shield case containing the mass analysis portion is electrically connected to the ground. In the case of measurement of negative ions, the polarities of voltages applied to the respective electrodes are inverted.

Further, an important meaning is in that the direction of deflection is set to be reverse to the direction of gravity. This is because, when extremely large droplets are introduced into a vacuum, the droplets fall down in a shape as they are in the direction of gravity. It is further important that a vacuum pump as a main evacuation system is arranged nearly under the lens so that the deflection portion can be evacuated efficiently. Generally, this region is evacuated in a range of from about $10^{-5}$ to about $10^{-6}$ Torr by a turbo molecular pump (evacuating rate: hundreds of liters per second). After ions are detected by a detector 14, the ion detection signal is amplified by an amplifier 15 and transferred to a data processor 16. Generally, the ion detection signal is outputted in the form of a mass spectrum or chromatogram.

Figure 7:
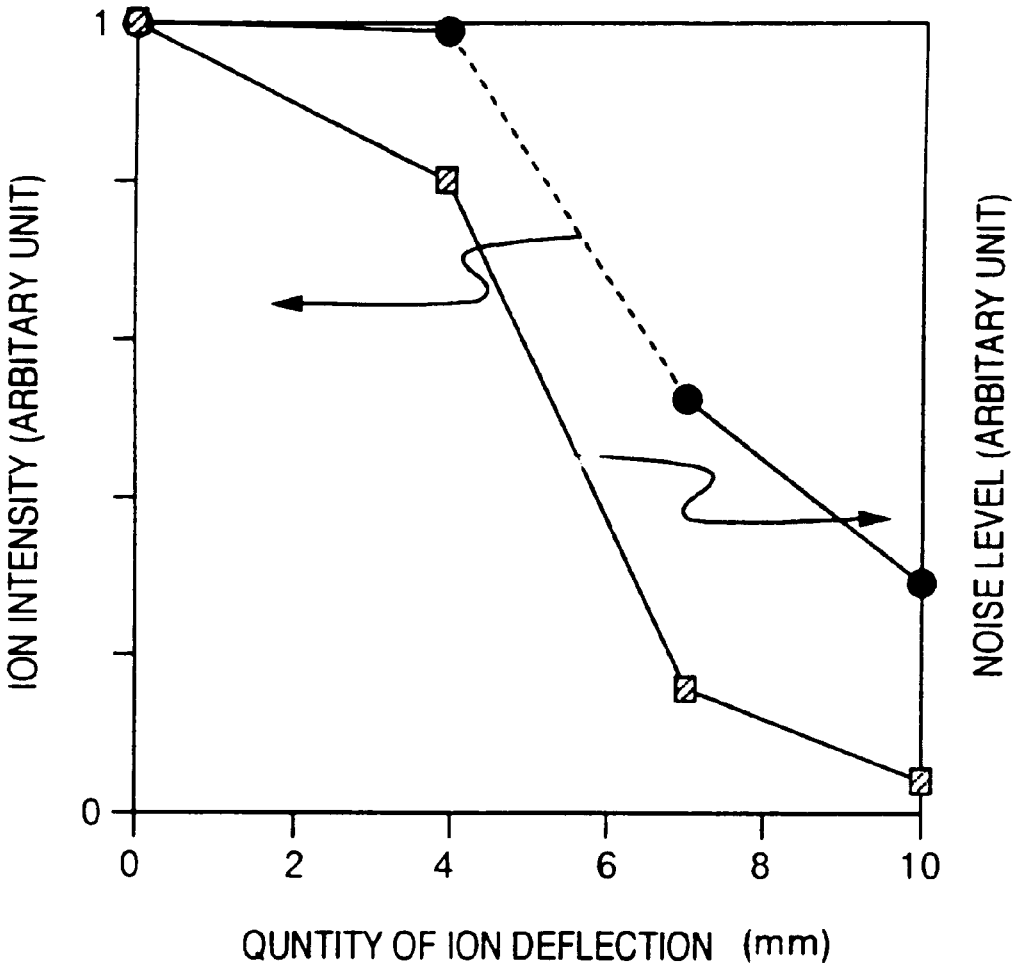
FIG. 7 is a graph showing the relation between the quantity of ion deflection and ion intensity and the relation between the quantity of ion deflection and the noise level in the case where no slit is provided.
Figure 8:
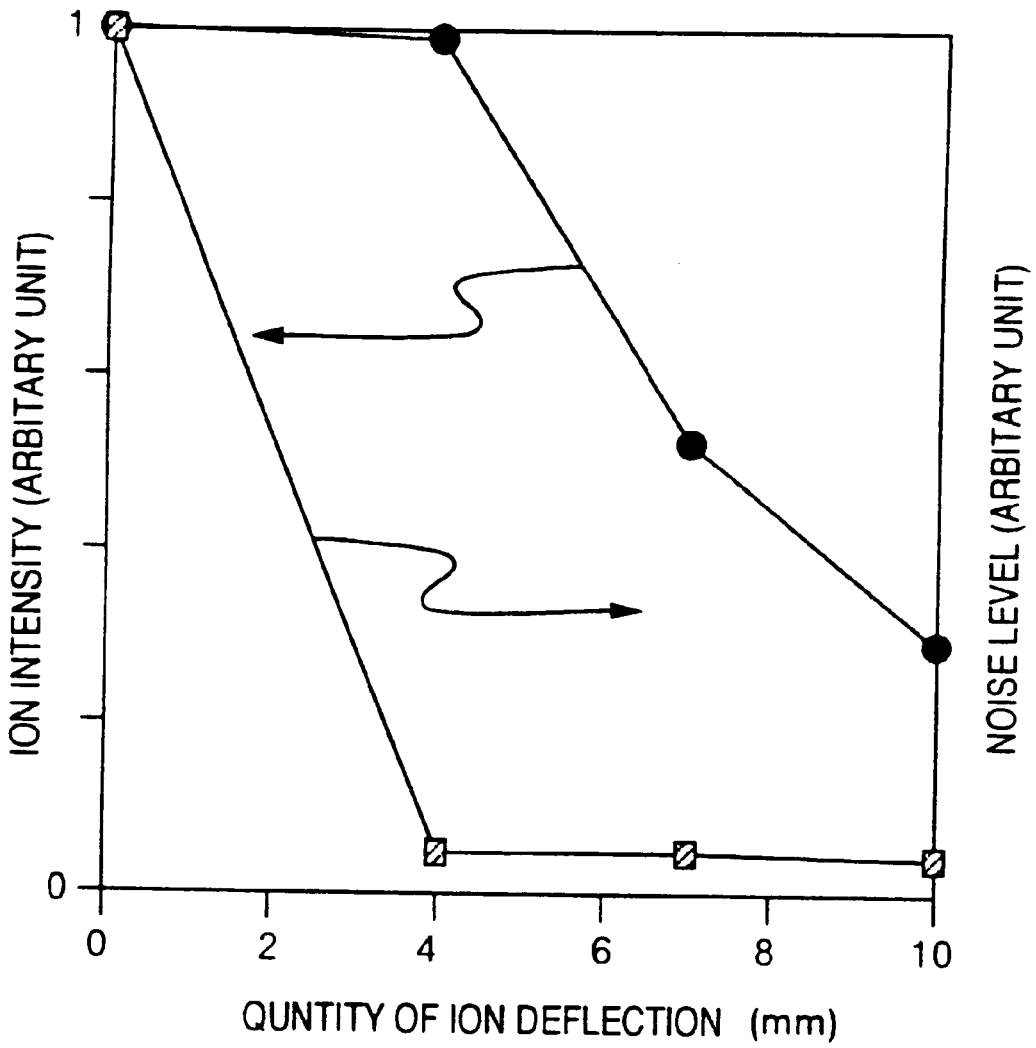
FIG. 8 is a graph showing the relation between the quantity of ion deflection and ion intensity and the relation between the quantity of ion deflection and the noise level in the case where a slit is provided.

FIG. 7 shows the relation between the ion intensity and the quantity of ion deflection in a range of from the ion take-out aperture 7 of the differential pumping portion to the ion take-in aperture 12 of the mass analysis portion in the double-cylindrical deflection lens described preliminarily in the case where no slit is provided. In this occasion, the ion intensity is normalized by a value in the case where the quantity of deflection is 0 mm. It is apparent from this result that the lowering of ion intensity is little observed when the quantity of deflection is not larger than 4 mm. It is however apparent that ion intensity is lowered to about ½ or ⅓ when the quantity of deflection is increased to 7 mm or 10 mm, respectively. FIG. 7 shows the relation between the noise level (a value obtained by adding noises of in a range of from 100 to 150 to the value of mass/charge on the measured mass spectrum) and the quantity of deflection in the case where no slit is provided. In this occasion, the noise level is normalized by a value in the case where the quantity of deflection is 0 mm. It is apparent that the noise level is reduced greatly when the quantity of deflection is increased to 7 mm or 10 mm compared with the case where the quantity of defection is 0 mm or 4 mm. On the other hand, FIG. 8 shows results in the case where a slit is provided in the preliminarily described condition. It is apparent that the lowering of the noise level cannot be expected when the quantity of deflection is 0 mm but the noise level is reduced to about 1/10 as much as the noise level in the case where no slit is provided when the quantity of deflection is 4 mm. Furthermore, the reduction of ion intensity is little observed. The aforementioned results show that noises can be reduced greatly without reduction of signals to thereby finally make it possible to improve the signal-to-noise ratio greatly by systematically combining the two techniques, by means of a slit, for cutting a large part of small droplets and neutral particles flowing-in through the ion take-in aperture of the differential pumping portion, and for deflecting ions selectively slightly.

Figure 9A:
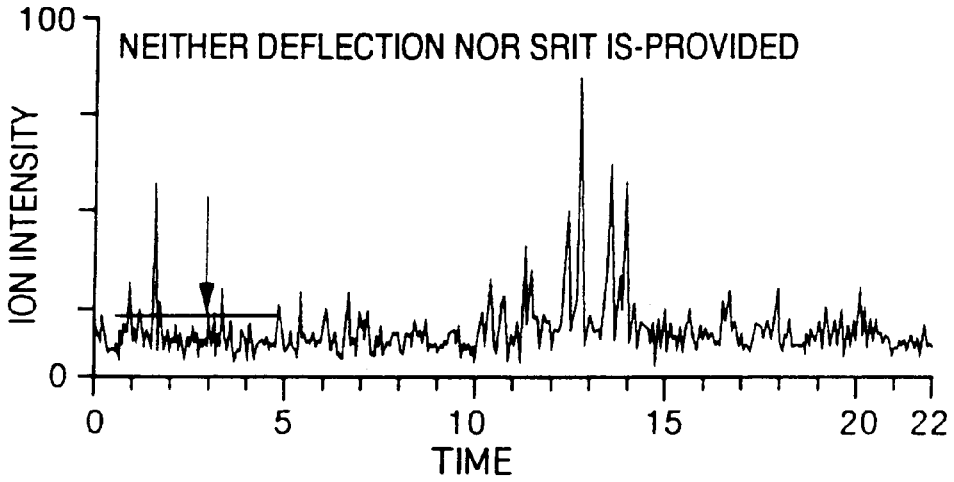
FIG. 9A and 9B are graphs of the total ion chromatogram of steriods showing an effect of the present invention.
Figure 9B:
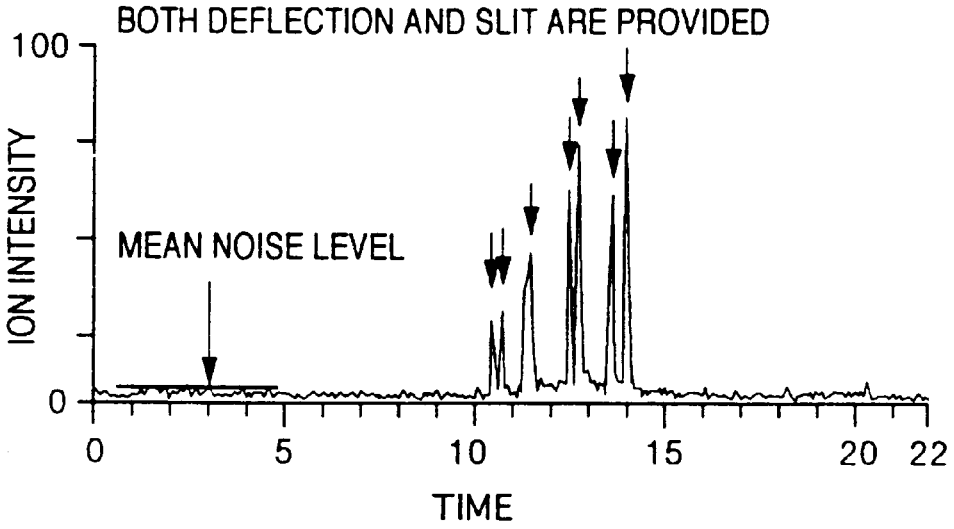

Upon the aforementioned results, data of a liquid chromatograph/mass spectrometer is obtained in practice. FIGS. 9A and 9B show comparison between a total ion chromatogram in the case where an atmospheric pressure chemical ionization method is employed in an ion source in a conventional apparatus and a total ion chromatogram in the case where the same method is employed in an ion source in an apparatus according to the present invention. Arrows indicate sample positions. Steroids are used as samples. The total ion chromatogram herein used means a result of observation of the change with the passage of time, of a value obtained by adding up ion intensity on mass spectra obtained by repeatedly scanning a certain mass range. Accordingly, if there is any sample, ions concerning the sample are observed. The measurement condition used herein was as follows. As the mobile phase for the liquid chromatograph for separation, A: water and B: methanol were used. A gradient analysis mode was used in which a state of 90% A and 10% B was changed to a state of 100% B in 10 minutes. As the samples used were 8 kinds of samples, namely, cortisone, cortisol, cortisol acetate, corticosterone, testosterone, methyltestosterone, testosterone acetate, and testosterone propionate. The quantity of each sample was about 140 pmol. In the case where there is neither ion deflection nor provision of any slit, in spite of the fact that seven components are separated by the liquid chromatograph, three of the seven components cannot be clearly recognized because of high noises. In the case of an apparatus according to the present invention, that is, in the case where not only ions were deflected but also a slit was provided, however, all the seven components introduced could be clearly detected because of great reduction of noises though the same quantity of the sample was introduced. It is further apparent that the signal-to-noise ratio is finally improved by 5 times or more because the noise level is reduced greatly to ⅕ times or less while the signal intensity is not reduced.

Figure 10:
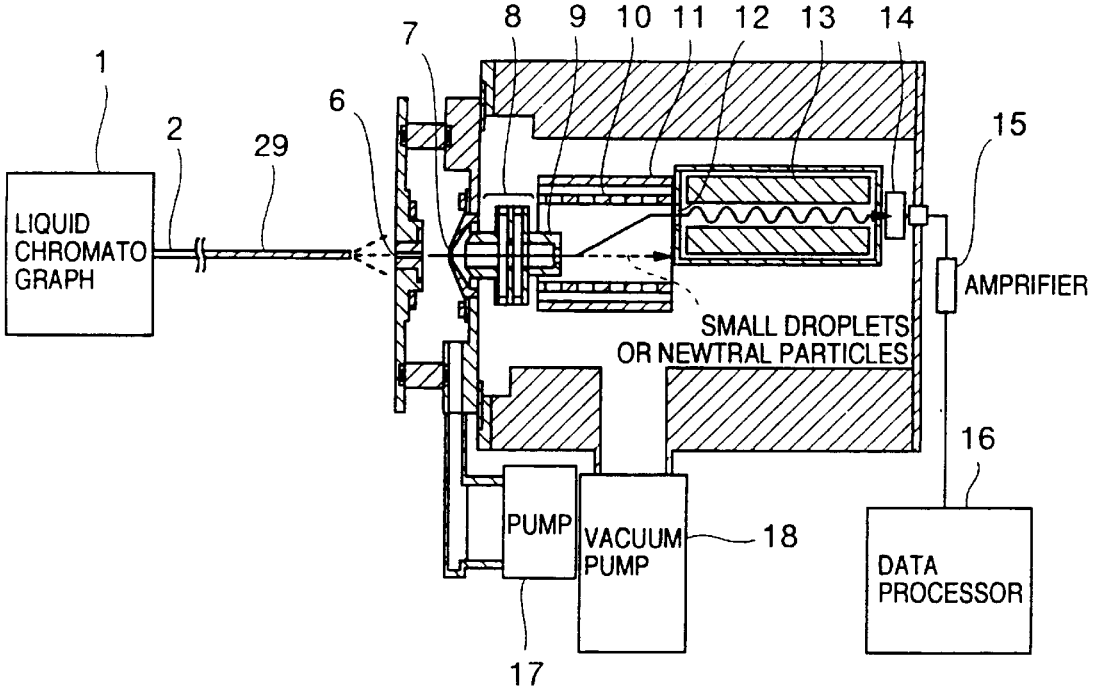
FIG. 10 is a structural view of an apparatus showing an embodiment of the present invention using an electrostatic spraying method.
Figure 11A:
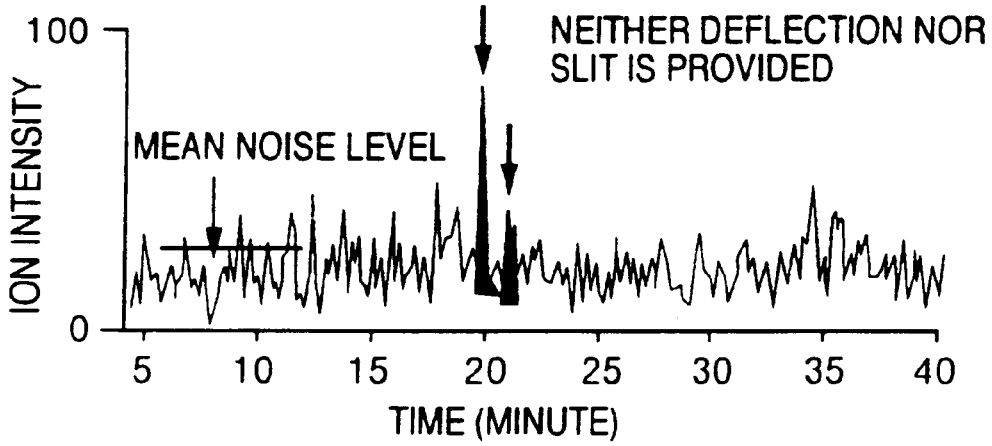
FIGS. 11A and 11B are graphs of the total ion chromatogram of peptides showing an effect of the present invention.
Figure 11B:
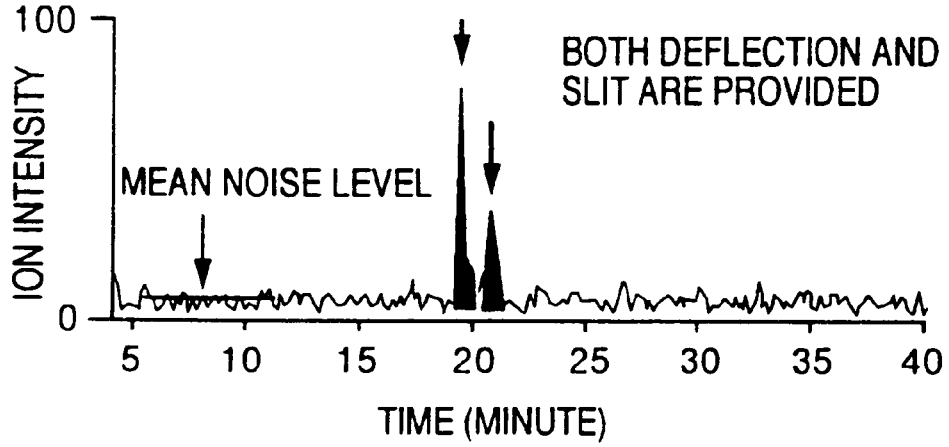

The following example shows the case where an electrospray method as a kind of atmospheric pressure ionization method is used. FIG. 10 is a structural view of an apparatus using this method. In this method, a sample solution eluted form the liquid chromatograph 1 is first introduced into a metal capillary 29. If a high voltage is applied between the metal capillary 29 and an electrode having an ion take-in aperture 6 and being opposite to the metal capillary 29, the sample solution is electrostatically sprayed from a forward end of the metal capillary 29. Droplets containing ions generated at this time are introduced through the ion take-in aperture 6. The other apparatus configuration and measurement principle are the same as those in FIG. 1. FIGS. 11A and 11B show results of total ion chromatograms obtained by a liquid chromatograph/mass spectrometer using the electrospray method. Arrows indicate sample position. As samples used were about 70 pmol of angiotensin I and about 70 pmol of angiotensin II. The measurement condition used herein was as follows. As the mobile phase for the liquid chromatograph for separation, A: 0.1% TFA, 90% water and 10% methanol and B: 0.1% TFA, 40% water and 60% methanol were used. A gradient analysis mode was used in which a state of 100% A was changed to a state of 100% B in 30 minutes. From comparison between the case where the present invention is used and the case where the present invention is not used, it is apparent that the noise level is reduced greatly to ⅕ or less though the signal intensity of angiotensin I and angiotensin II are not changed. That is, the signal-to-noise ratio was improved to 5 times or more by the use of the present invention.

Although the above description has been made about the case where a liquid chromatograph/mass spectrometer is mainly used for analysis of an organic compound, the same effect as described above is attained also in the case of a capillary electrophoresis system/mass spectrometer.

Further, the present invention is effective in the case of a plasma mass spectrometer in which ions generated by ionizing a metal, or the like, in a solution by plasma are detected by a mass spectrometer. In this case, photons generated from plasma as well as small droplets and neutral particles are a main cause of noises in the detector. The combination of the provision of a slit and the slight deflection of ions according to the present invention is very effective also for removing such photons.

Figure 12:
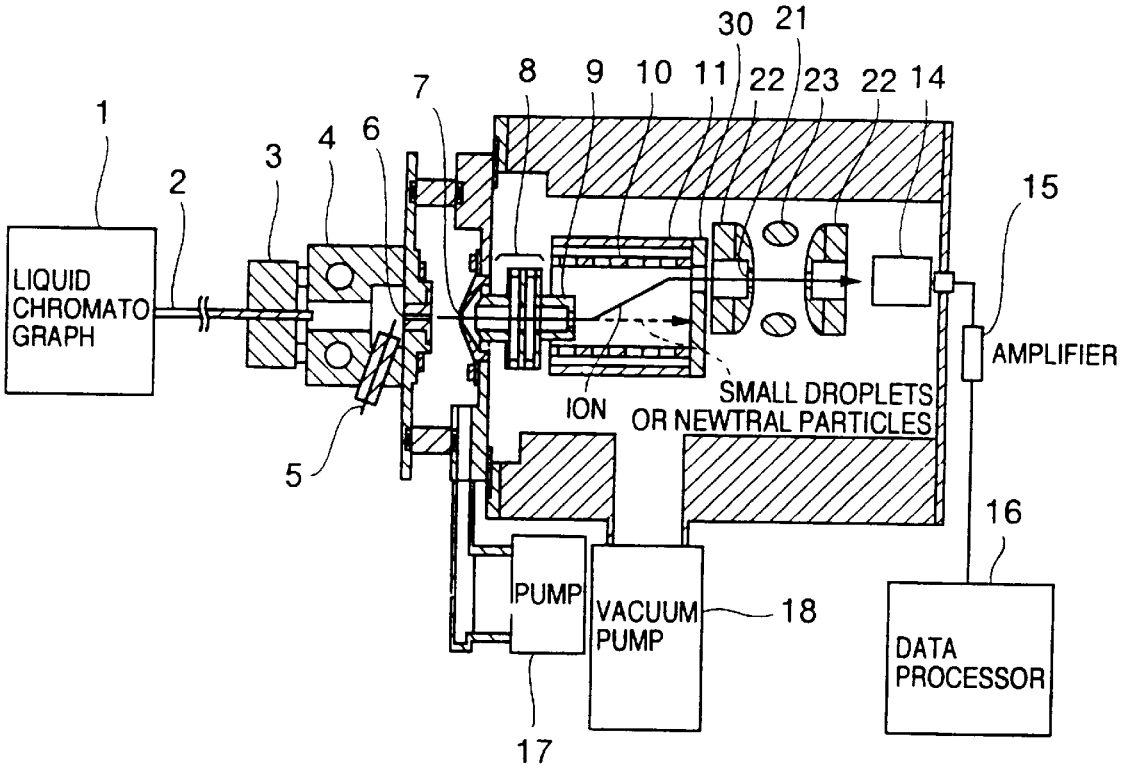
FIG. 12 is a structural view of an apparatus showing an embodiment of the present invention.

Although the previous example has been described about the case where a quadrupole mass analysis portion 13 is used as the mass analysis portion, the same effect as described above can be expected also in the case where another mass spectrometer such as an ion trap mass spectrometer, or the like, is used in place of the quadrupole mass analysis portion 13. FIG. 12 shows an example of the ion trap mass spectrometer. The ion trap mass spectrometer is a mass spectrometer constituted by a pair of cup-like end cap electrodes 22 and a ring electrode 23 disposed between the pair of end cap electrodes 22. The ion trap mass spectrometer uses a high-frequency electric field to perform mass analysis.

Figure 19:
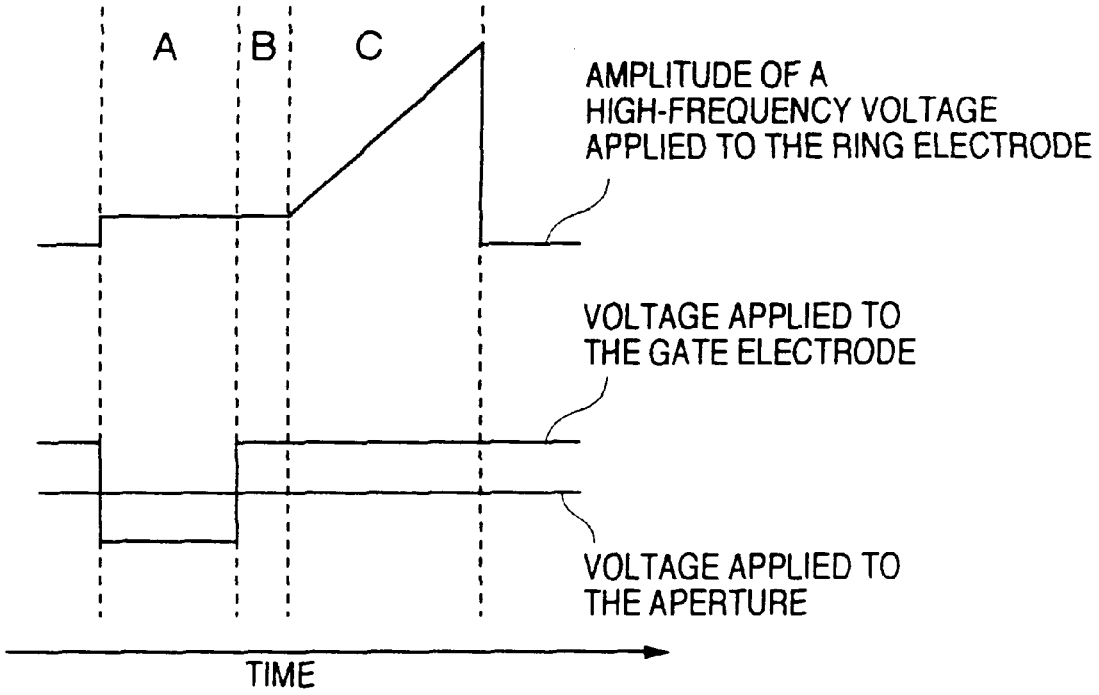
FIG. 19 is a graph showing voltages applied to a ring electrode and a gate electrode respectively in an ion trap mass spectrometer.

The operation of the ion trap mass spectrometer in the case of analysis of positive ions will be described below. A voltage to be applied to the ring electrode 23 and a voltage to be applied to a gate electrode 30 for controlling introduction of ions into the mass analysis portion and performing shielding to prevent the high-frequency electric field of the mass analysis portion from having influence on the electric field of the electrostatic lens are controlled by a controller not shown. FIG. 19 shows the amplitude of the high-frequency electric voltage applied to the ring electrode 23 and the voltage applied to the gate electrode 30. In the condition in which a high-frequency voltage is applied to the ring electrode 23 in order to enclose ions and in which a voltage lower than the voltage of the ion take-out aperture 7 of the differential pumping portion is applied to the gate electrode 30, ions pass through the gate electrode 30 so that ions are introduced into the ion trap region and enclosed in the ion trap region (A in FIG. 19). When a voltage higher than the voltage of the ion take-out aperture 7 of the differential pumping portion is then applied to the gate electrode 30 while a high-frequency voltage is continuously applied to the ring electrode 23 to enclose ions, ions cannot pass through the gate electrode 30 so that the flowing of ions into the ion trap region (the ion trap mass analysis region) stops. Because the inside of the ion trap region is filled with a helium gas having a predetermined pressure, the kinetic energy of the ions enclosed in the ion trap region is lost by collision of the ions with the helium gas, so that the ions are concentrated into the center portion of the ion trap region which is low in potential (B in FIG. 19). If the amplitude of the high-frequency voltage applied to the ring electrode 23 is increased gradually, the orbits of ions are made unstable in the ascending order of the value obtained by dividing the mass of the respective ion by the electric charge thereof, so that the ions are withdrawn out of the ion trap region (C in FIG. 19).

Also in this case, the combination of removal of small droplets and neutral particles by means of a slit and slight deflection of ions through the gate electrode 30 for controlling introduction of ions into the ion trap mass analysis portion and for eliminating the influence of the high-frequency electric field from the ion trap mass analysis portion before introduction of ions into the ion take-in aperture 21 of the end cap electrode located in the ion source side greatly contributes to reduction of noises. Particularly in the case of the ion trap mass spectrometer, the present invention is more effective than the case of the quadrupole mass spectrometer. In the quadrupole mass spectrometer, the ion take-in aperture 12 of the mass analysis portion has a relatively large diameter of about 3 mm. Accordingly, reduction of ion transmission efficiency is not so great even in the case where the focusing condition at the ion take-in aperture 12 of the mass analysis portion is poor, that is, even in the case where the ion beam is spread at this portion. In the ion trap mass spectrometer, however, the ion take-in aperture provided in the end cap electrode cannot be made so large in order to prevent increase of the disturbance of the high-frequency electric field in the inside. Generally, the diameter of the ion take-in aperture is set to about 1.3 mm which is smaller than that in the case of the quadrupole mass spectrometer. Accordingly, in the ion trap mass spectrometer, when ions are deflected in the conventional manner, the lowering of ion transmission efficiency becomes remarkable because the focusing condition at the ion take-in aperture is poor if the ion beam is spread at the ion take-in aperture. From this point of view, it is also very effective that the present invention is applied to the ion trap mass spectrometer.

Figure 13:
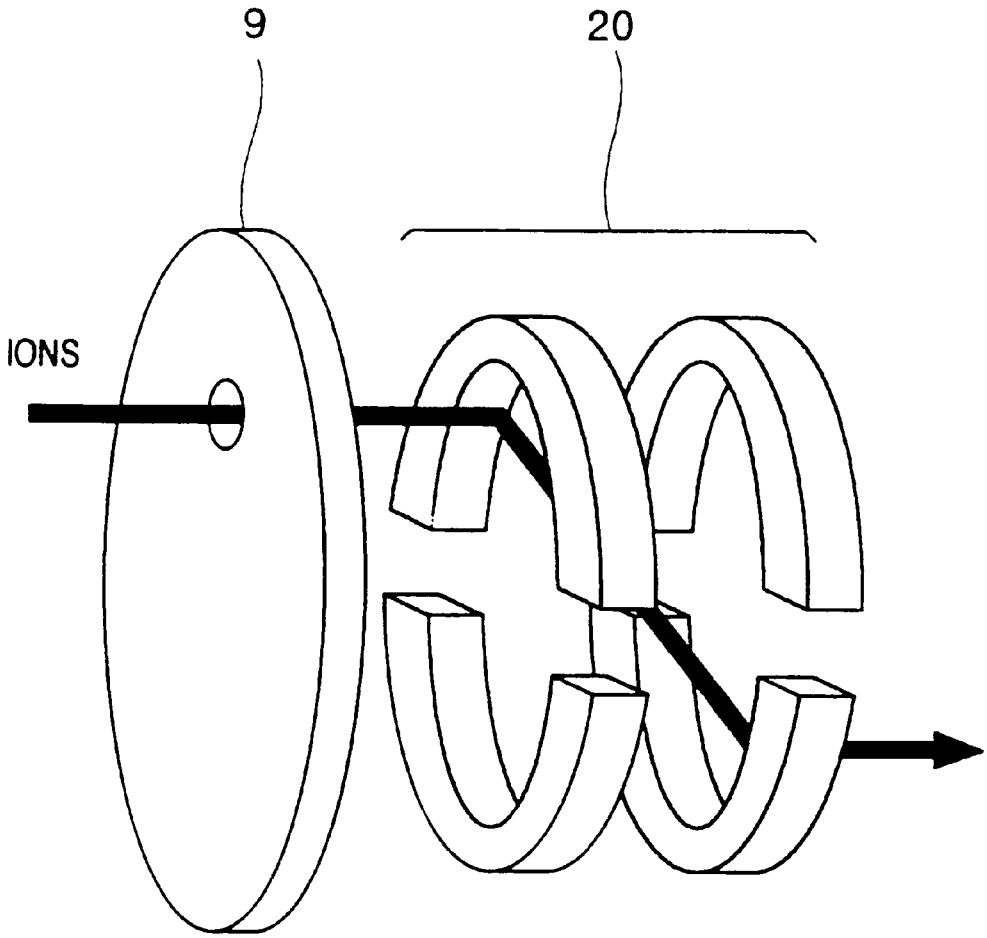
FIG. 13 is a structural view of an apparatus showing an embodiment of the present invention.
Figure 14:
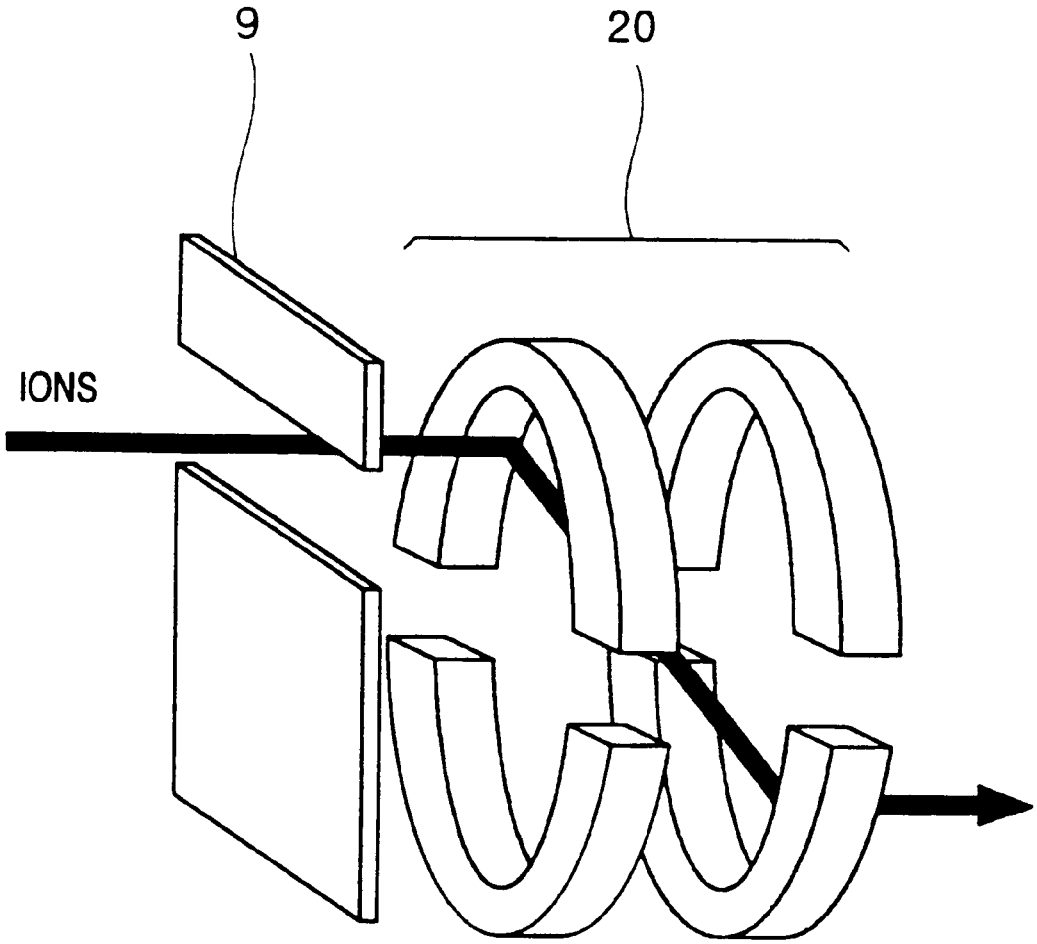
FIG. 14 is a structural view of an apparatus showing an embodiment of the present invention.
Figure 15:
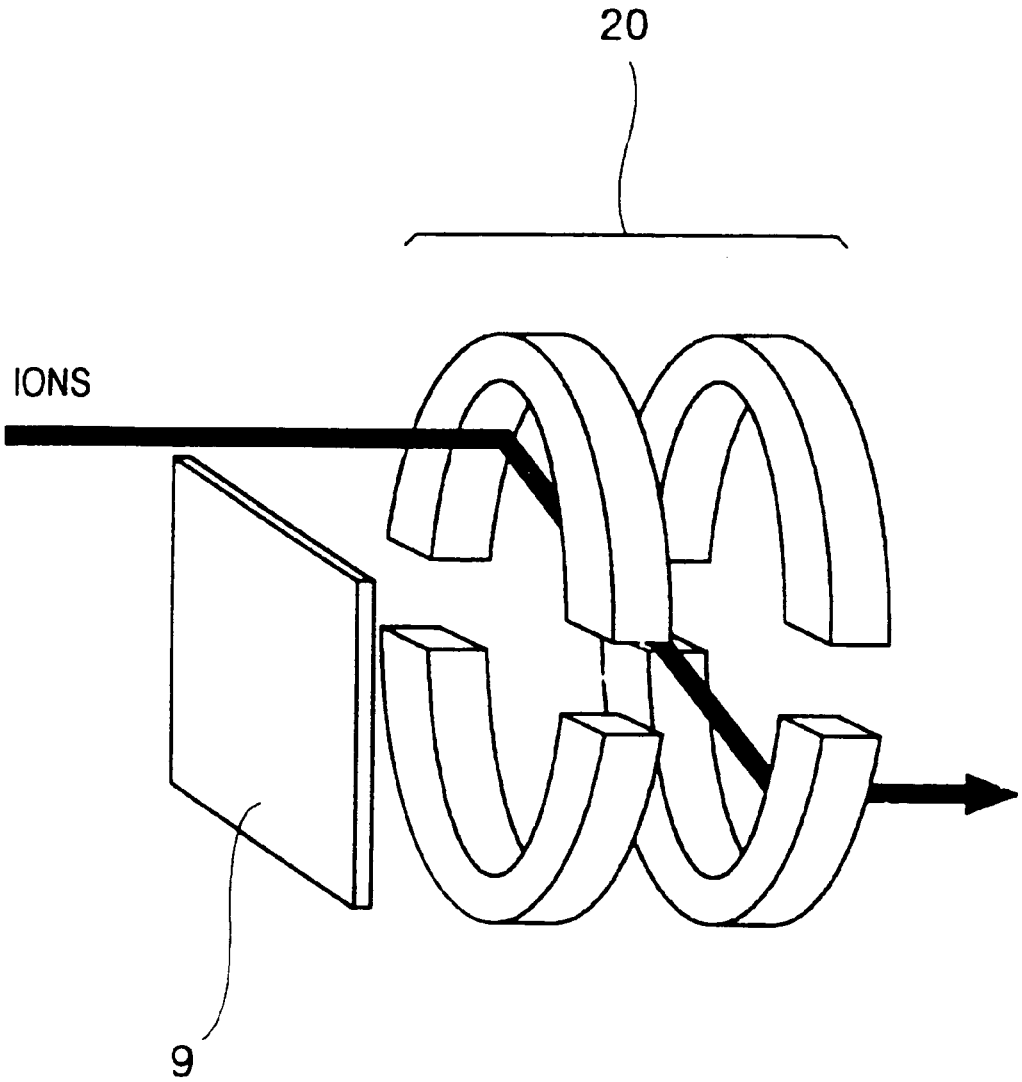
FIG. 15 is a structural view of an apparatus showing an embodiment of the present invention.
Figure 16:
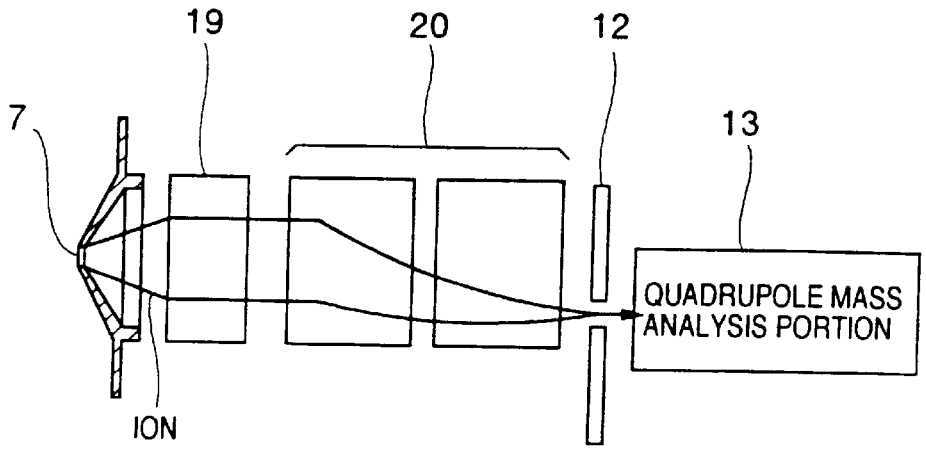
FIG.16 PRIOR ART
FIG. 16 is a structural view of a conventional apparatus.
Figure 17:
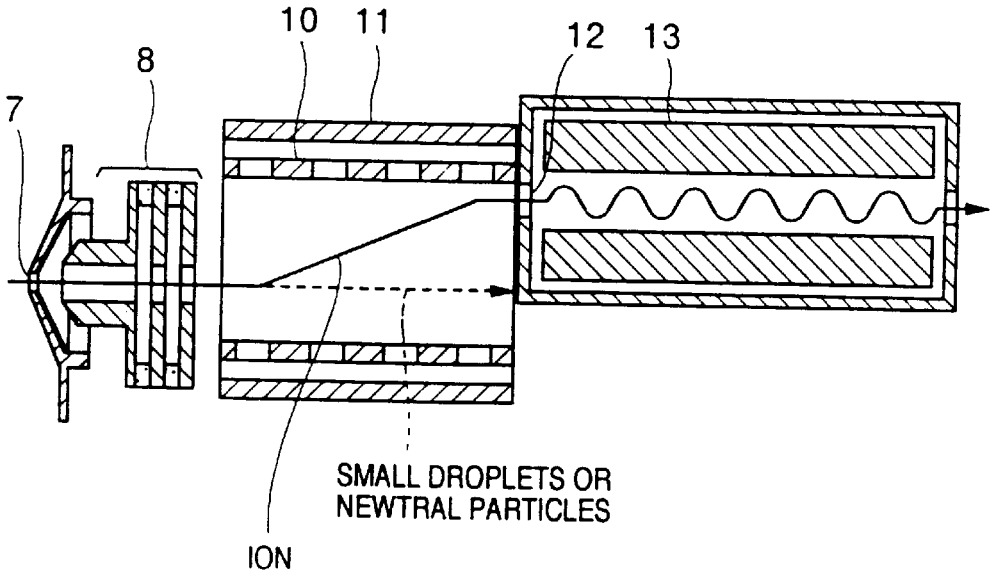
FIG.17 PRIOR ART
FIG. 17 is a structural view of a conventional apparatus.
Figure 18:
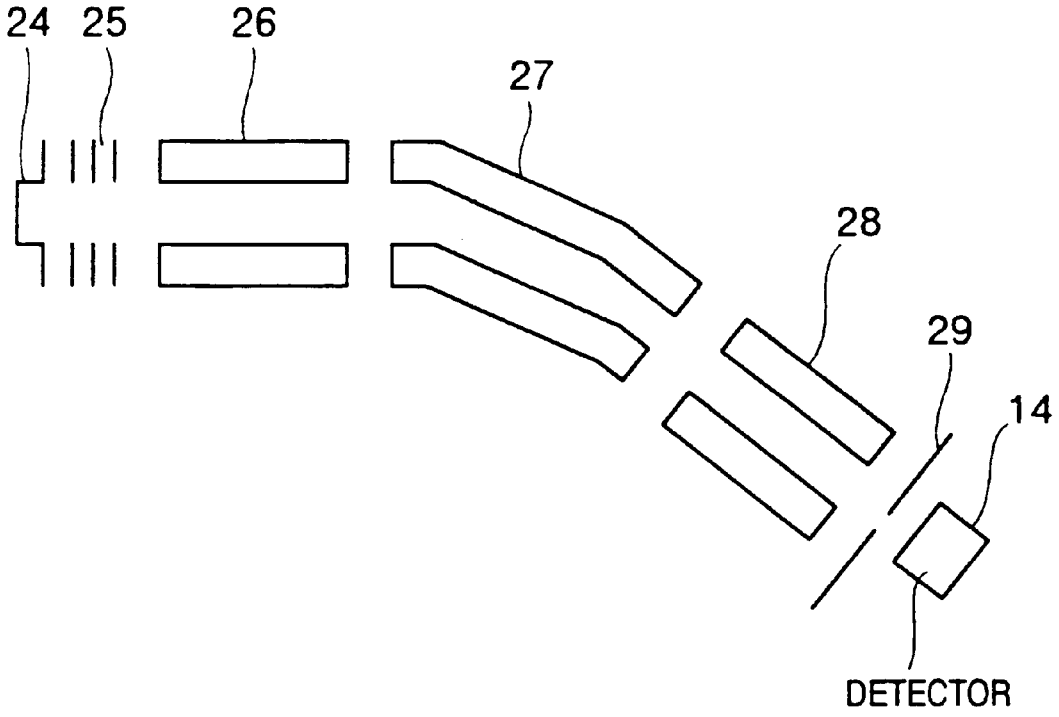
FIG.18 PRIOR ART
FIG. 18 is a structural view of a conventional apparatus.

Although the above description has been made about the case where a double-cylindrical electrostatic lens is used for deflecting and focusing ions, it is also effective to combine the slit 9 with such a type of deflector 20 as disclosed in U.S. Pat. No. 4,999,492 and as shown in FIG. 13. The deflector 20 disclosed therein has such a shape as shown in FIG. 13. If a slit is provided in front of the deflector of this type, the same effect as in the case of the double-cylindrical electrostatic lens is attained. Also in this case, an example shown in FIG. 14 (in which a slit is formed by two plates) and an example shown in FIG. 15 (in which a slit is formed by a plate provided in the direction of deflection) are thought of. When deflectors of the types shown in FIGS. 13 to 15 are designed in practice, however, it becomes clear that the following problem arises. That is, in these deflectors, electric fields for deflecting ions are generated correspondingly to the electric fields generated from the respective electrodes interfere with each other to form a complex electric field distribution because the respective electrodes are not shielded from each other. Accordingly, the effect of interference between electric fields must be discussed in order to produce a deflector which is high in ion transmission efficiency. It is however difficult to grasp the effect of interference accurately in a deflector using a plurality of electrodes each having a complex shape. In the double-cylindrical electrostatic lens shown in FIG. 2, ions are deflected and focused by electric fields penetrating into the inner cylindrical electrode through the aperture portions provided in the inner cylindrical electrode but the electric fields penetrating into the inner cylindrical electrode through the aperture portions do not interfere with each other because the aperture portions are independent of each other. Accordingly, the double-cylindrical electrostatic lens is superior to the conventional deflector in that the effect of deflecting and focusing the ion beam can be predicted easily in the case of the double-cylindrical electrostatic lens.

Figure 20:
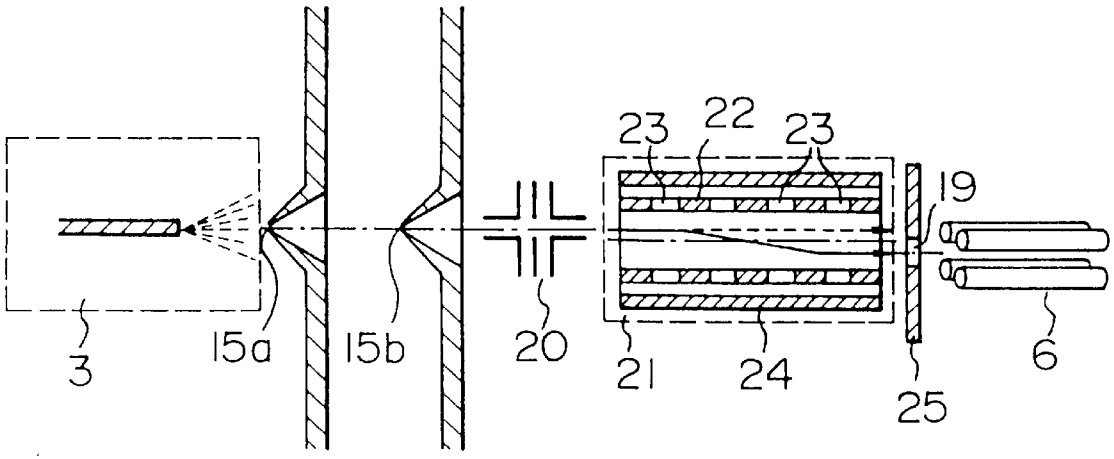
FIGS. 20, 21, 22 and 23 are sectional views showing examples of the electrostatic lens used in respective embodiments of the present invention.

FIG. 20 shows a structure for deflecting ions by using an electrostatic lens composed of multiple concentrically-assembled cylindrical electrodes as described in JP-A-2-78143. An inner electrode 22 is equipped with a plurality of holes 23 through which the electric field of an outer electrode 24 penetrates into the inside of the inner electrode 22. A potential distribution for focusing ions is formed by the penetrated electric field. When the center axis of the concentrically cylindrical electrostatic lens 21 is offset from the center axis of the ion sampling apertures 15*a* and 15*b*, ions are deflected so as to move on the orbit represented by the solid line in the electrostatic lens 21 in FIG. 20. The mass analysis region 6 is arranged to align the ion introducing aperture 19 opening with the ion orbit at an end of the electrostatic lens 21. Charged droplets or droplets without charge move on an orbit represented by the broken line. Because charged droplets or droplets without charge collide with portions of electrode 25 other than the open ion introducing aperture 19 entrance into the mass analysis region 6 is prevented. The ions moved on the orbit of the solid line by deflection are introduced through the ion introducing aperture 19 into the mass analysis region. The electrode 25 is preferably heated by a heater or the like at this time to reduce the contamination of the electrode 25 having the ion introducing aperture 19 opened therein, due to the charged droplets or droplets without charge.

The feature of the electrostatic lens shown in FIG. 20 is that deflection of ions and focusing thereof can be achieved simultaneously by a single electrostatic lens constructed by two cylindrical electrodes. In the case where an electrostatic lens portion is to be formed generally, the respective electrodes constituting the electrostatic lens require processing accuracy. Where the respective electrodes are placed in predetermined positions, close attention is paid to assembling accuracy. This is because small difference in the arrangement of the respective electrodes greatly changes the ion orbit. To deflect and focus ions, a complicated potential distribution must be formed in the electrostatic lens portion. Accordingly, a large number of electrodes and a complicated structure are required, so that assembling efficiency deteriorates. Therefore, the number of electrodes constituting the electrostatic lens is preferably as small as possible. When an electrostatic lens constituted by two concentrically assembled cylindrical electrodes as shown in FIG. 20 is used and arranged so that the center axis of the electrostatic lens is shifted from the center axis of the ion sampling apertures, an apparatus with a favorable assembling efficiency and a simple structure can be produced because the number of electrodes constituting the electrostatic lens is only two.

An example of the size of the electrostatic lens shown in FIG. 20 will be described below. Assuming now that the inner diameter of the inner electrode 22, the inner diameter of the outer electrode 24, the axial length of the electrode and the difference between the center axis of the ion sampling apertures 15*a* and 15*b* and the center axis of the ion introducing aperture 19 are 20 mm, 30 mm, 15 cm and 4 mm respectively, then the S/N is increased by about eight times so that the sensitivity in the mass spectrometer is improved to be nearly about one order of magnitude. The inner diameter of the inner electrode is preferably in a range from 3 to 10 cm. The axial length of the electrode is preferably larger than the inner diameter of the inner electrode.

Figure 21:
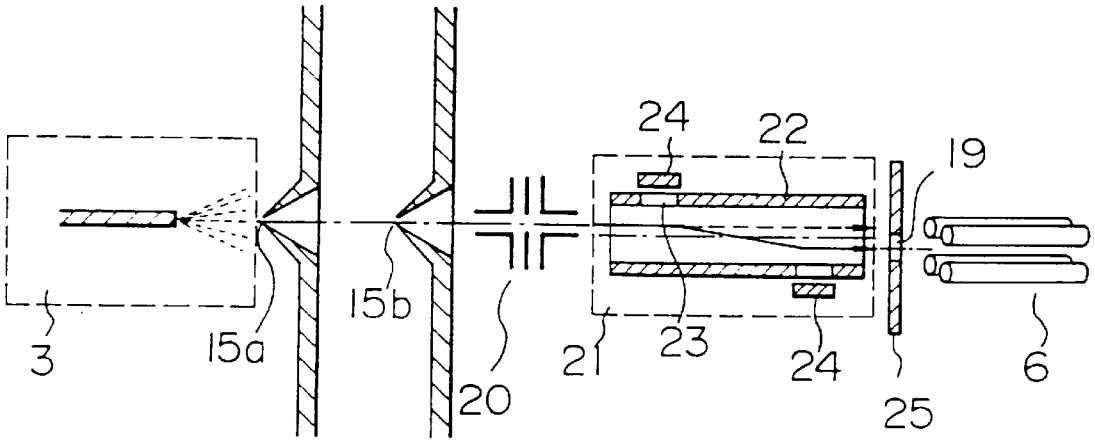
Figure 22:
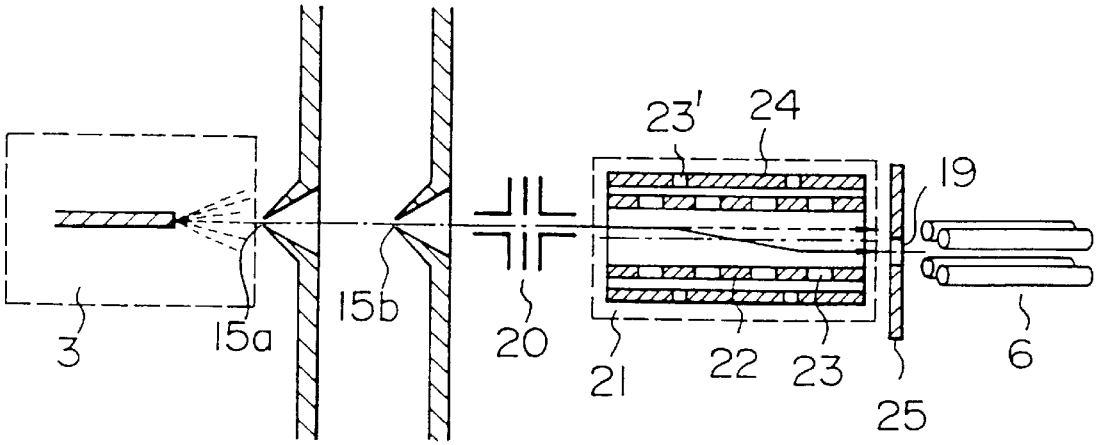
Figure 23:
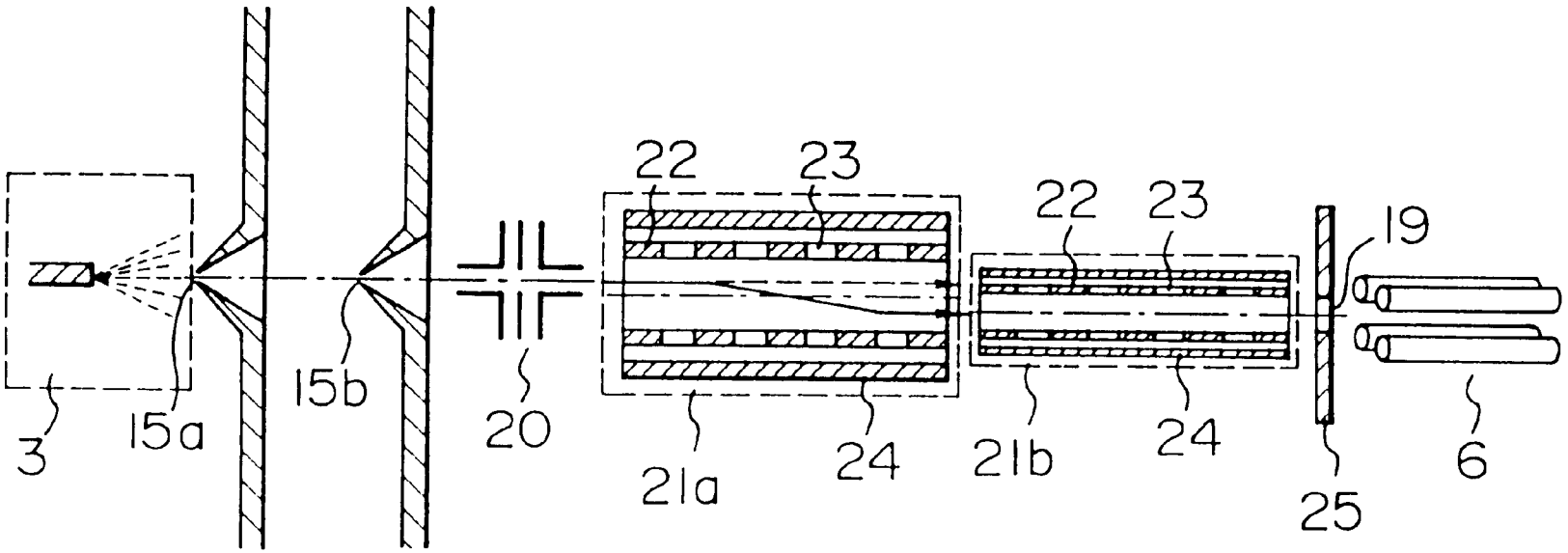

To form the ion deflecting and focusing electrostatic lens simply and accurately, the electrostatic lens is preferably constituted by inner and outer cylindrical electrodes arranged concentrically as shown in FIG. 20. The outer electrode 24 may be not always constituted by a single electrode. As shown in FIG. 21, plate-like individual outer electrodes 24 may be arranged outside opposite the holes 23 of the cylindrical inner electrode 22. In the case where evacuation conductance in the electrostatic lens portion is increased to thereby improve the degree of vacuum in the cylinder more greatly, evacuation holes 23' may be provided in the cylindrical outer electrode 24 as shown in FIG. 22. To further increase the evacuating efficiency, the outer electrode 24 may be constituted by metal meshes. In the case where ion energy is dispersed so that the dispersion of energy forms aberration to thereby spoil the focusing effect of the electrostatic lens portion, a plurality of electrostatic lenses 21*a* and 21*b* as shown in FIG. 23 may be arranged so that the electrostatic lens 21*b* having a smaller diameter than the inner diameter of the electrostatic lens 21*a* is placed in the rear portion of the first-stage electrostatic lens 21*a* to thereby increase the ion condensing effect. In this case, the center axis of the electrostatic lens 21*b*, placed nearer to the mass analysis region 6, is made to coincide with the center axis of the ion introducing aperture 19. The respective center axes of the electrostatic lenses 21*a* and 21*b* are arranged in parallel and offset from each other. Further, in FIGS. 20–23, the center axis of the ion introducing aperture 19 and the center axis of the mass analysis region 6 are coincident with each other and are arranged in parallel and offset from the center axis of the ion sampling apertures.

Figure 24:
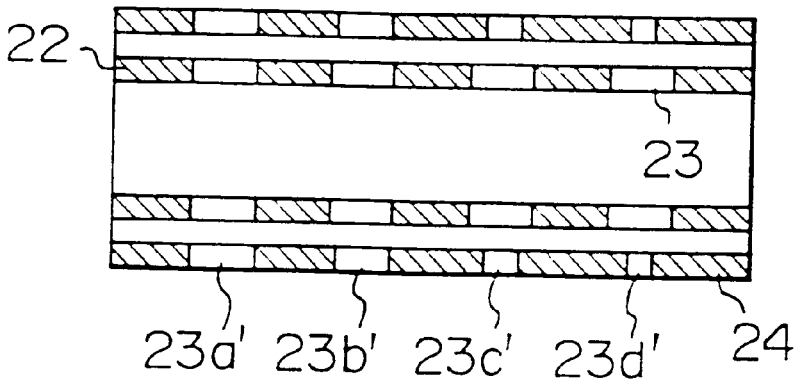
FIGS. 24 and 25 are views showing examples of the structure of the electrostatic lens for accelerating or decelerating ions in the direction of the center axis according to a third embodiment of the present invention.
Figure 25:
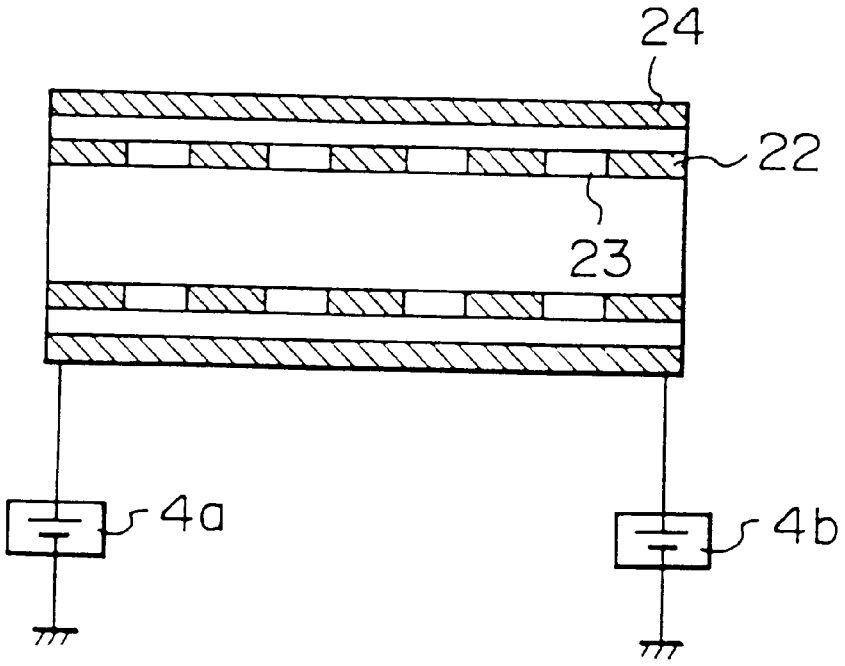

In the case where the intensity of electric field penetrating from the inner electrode of the electrostatic lens into the cylinder is changed to accelerate or decelerate ions to thereby change the focusing effect in the cylinder, the opening area of evacuation holes provided in the outer electrode may be changed in the direction along the center axis of the electrostatic lens. For example, FIG. 24 shows a structure for decelerating ions in the direction of the axis. When the respective opening areas of the holes 23'*a*, 23'*b*, 23'*c* and 23'*d* opened in the outer electrode 24 are reduced gradually along the center axis, the intensity of electric field penetrating into the cylinder of the inner electrode 22 changes in the direction of the center axis to thereby decelerate ions. Alternatively, different potentials may be applied to the opposite ends of the outer or inner electrode so that the intensity of electric field penetrating into the cylinder is changed in the direction of the axis by using the potential drop in the outer or inner electrode portion. FIG. 25 shows a structure in which voltages are applied to the opposite ends of the outer electrode 24 by power supplies 4*a* and 4*b* so that the axial gradient in the intensity of the electric field penetrating into the cylinder of the inner electrode 22 is changed arbitrarily by the voltage drop in the outer electrode 24. Here, the outer electrode 24 having the opposite ends supplied with the different voltages by the power supplies 4*a* and 4*b* is preferably formed of not a metal material but a resisting material to prevent excessive heating.

In the aforementioned structure, the electrostatic lens portion is preferably heated by a heater or the like to reduce the contamination of the electrostatic lens. Even in the case of an electrostatic lens which is constituted by a cylindrical inner electrode, an outer electrode located on in the outside of the inner electrode and has a plurality of holes at least in the inner electrode, at least one of the inner and outer electrodes is preferably heated by a heater or the like. Further, the electrode having the hole of the ion introducing aperture for introducing ions into the mass analysis region is also preferably heated.

Figure 26:
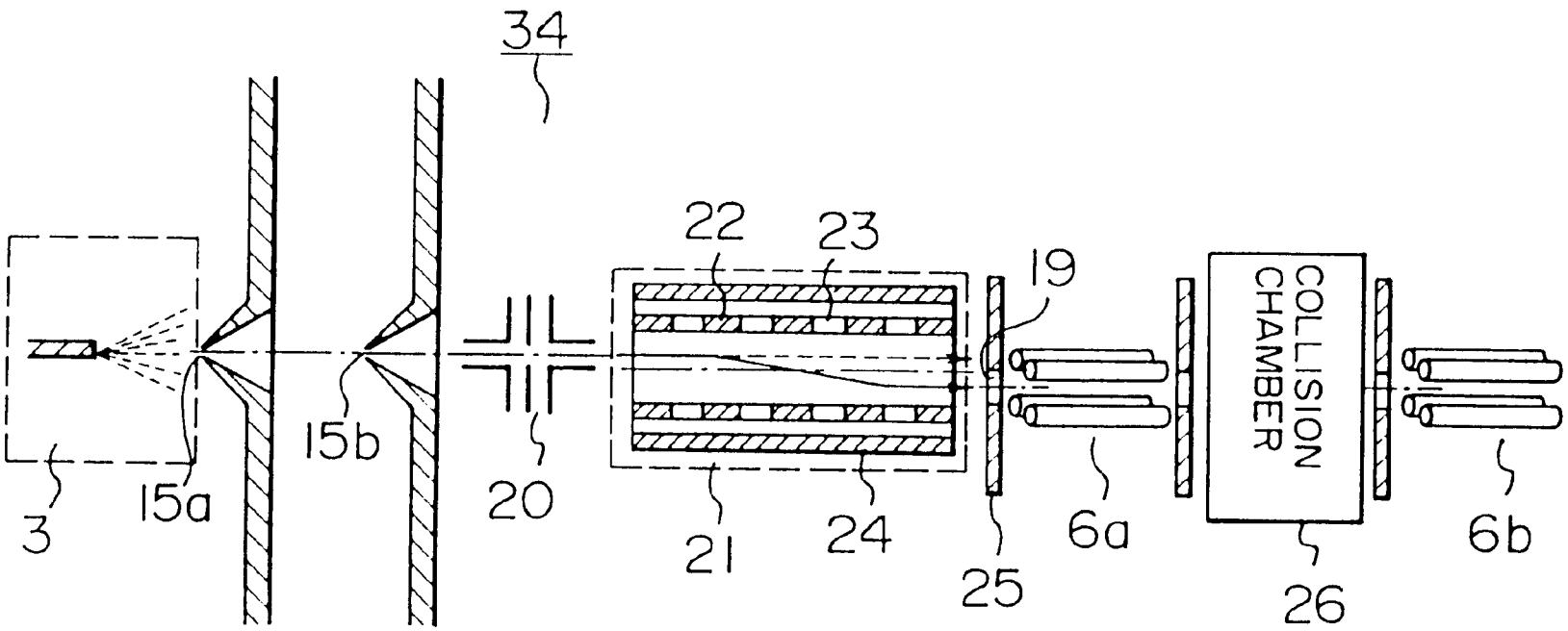
FIG. 26 is a view showing the structure of a mass spectrometer using a combination of a large number of mass analysis regions according to a fourth embodiment of the present invention.

FIG. 26 shows an embodiment of a mass spectrometer having a plurality of mass analysis regions arranged in multiple stages. After ions introduced through the ion sampling apertures 15*a* and 15*b* into the vacuum region 34 are separated from charged droplets or droplets without charge by the electrostatic lens 21, the ions are introduced to a first-stage mass analysis region 6*a* and are mass separated. The mass-separated ions to be analyzed are fed into a collision chamber 26. In the collision chamber 26, the ions collide with neutral gas and cleft into so-called fragment ions. The fragment ions are further introduced into a second-stage mass analysis region 6*b* and are mass analyzed. Even in the case of such a mass spectrometer having a plurality of mass analysis regions, the structure in which an electrostatic lens for deflecting ions is arranged between the ion sampling aperture and the first-stage mass analysis region is effective. The respective center axes of the ion sampling apertures, electrostatic lens, ion introducing aperture and first-stage mass analysis region 6*a* are arranged in the same manner as in the first embodiment.

Figure 27:
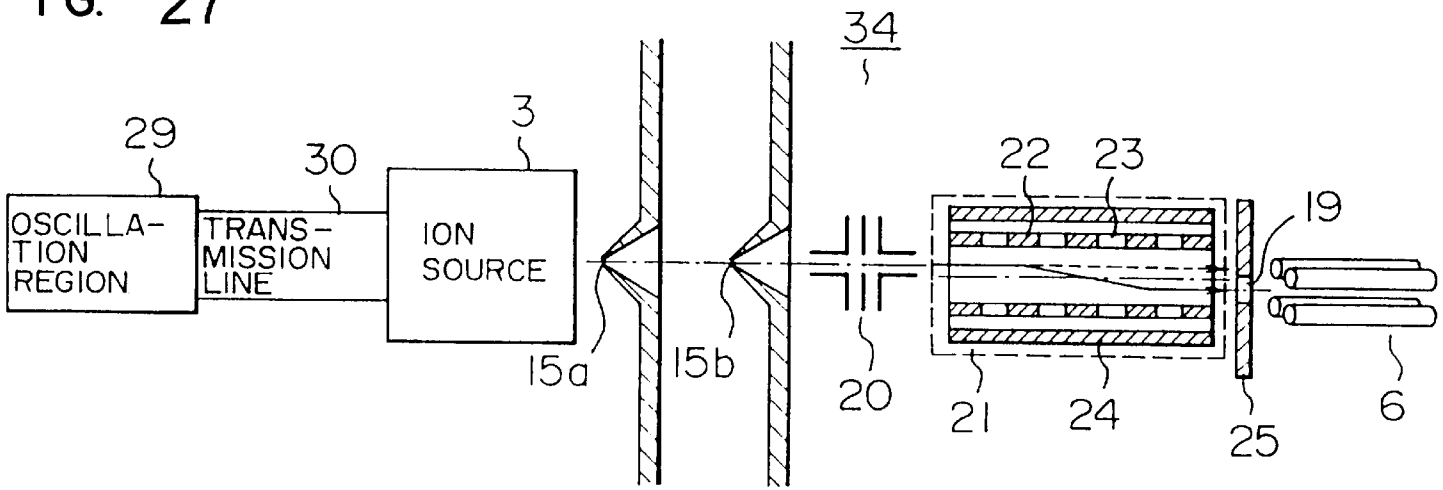
FIG. 27 is a view showing the structure of a mass spectrometer in which ions are generated in plasma according to a seventh embodiment of the present invention.

FIG. 27 shows an example of the structure of a mass spectrometer which is different from the mass spectrometer for analyzing a mixture in solution but has an inductively coupled plasma source or a microwave-induced plasma source. High-frequency electromagnetic wave such as microwave obtained from an oscillator 29 is introduced through a transmission line 30 into the ion source 3. A resonator is provided in the ion source 3 so that a plasma state is generated by discharging in the resonator. The sample is introduced into the plasma, ionized and then introduced through the ion sampling apertures 15*a* and 15*b* into the vacuum region 34. If photons such as ultraviolet rays obtained by discharging reach the ion detector at this time, the photons are detected as noise. Only ions are deflected (as indicated by the solid line in the electrostatic lens 21) by the electrostatic lens 21 so that the ions can reach the mass analysis region 6, whereas photons move straight (as represented by the broken line in the electrostatic lens 21) and collide with the electrode 25 having the hole of the ion introducing aperture 19 so that the photons are eliminated. Accordingly, the sensitivity of the mass spectrometer having the inductively coupled plasma source or microwave-induced plasma source can be improved by the present invention. The respective center axes of the ion sampling apertures, electrostatic lens, ion introducing aperture and mass analysis region are arranged in the same manner as in the first embodiment.

Figure 28:
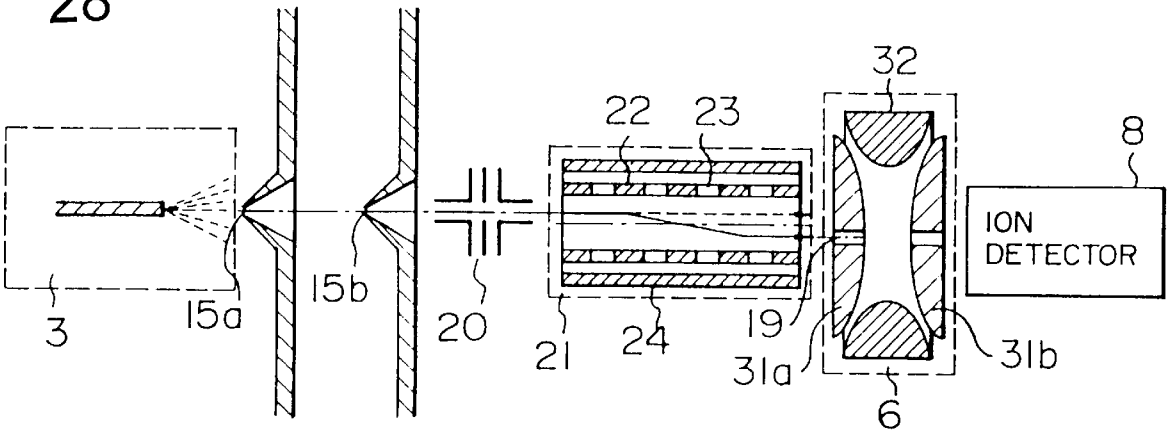
FIGS. 28 and 29 are views showing the structure of a mass spectrometer having an ion trap mass analysis region according to an eighth embodiment of the present invention.

The present invention is also effective for a mass spectrometer using mass analysis regions other than the quadrupole mass analysis region. FIG. 25 shows an example of the structure of a mass spectrometer having an ion trap mass analysis region. In the ion trap mass analysis region 6, ions are enclosed in a narrow space by a high-frequency electric field and analyzed. As shown in FIG. 28, the ion trap mass analysis region 6 is constituted by the following three electrodes: two electrodes 31*a* and 31*b* called "endcap electrodes" and a ring electrode 32 which is disposed so as to surround the endcap electrodes. Ions introduced through the ion sampling aperture into a vacuum are accelerated by the extracting electrode 20 and then deflected by the electrostatic lens 21. Then, the ions are guided into the ion trap by the endcap electrode 31*a* having the ion introducing aperture 19 opened therein.

In the ion trap, the ion orbit is controlled on the basis of the DC/AC electric field given by the endcap electrodes 31*a* and 31*b* and the ring electrode 32, so that only the ions having specific mass are enclosed. The enclosed ions are withdrawn from the endcap electrode 31*b* in accordance with the potential pulsatorily given to the endcap electrodes 31*a* and 31*b* at the opposite ends and detected by the ion detector 8. In the ion trap mass analysis region 6, mass analysis is performed in a closed space. If charged droplets or droplets without charge flow into the mass analysis region 6, the ring electrode 32 is contaminated with the charged droplets or droplets without charge. Because the ion trap mass analysis region 6 in FIG. 28 has a closed structure, the degree of contamination of the ring electrode 32 is relatively large compared with the quadrupole mass analysis region 6 in FIG. 1. If the ring electrode 32 is contaminated, the analysis characteristic of the mass analysis region 6 is changed to make long-term stable mass analysis difficult. Accordingly, the structure in which only the ions are deflected and introduced into the ion trap is effective.

Figure 29:
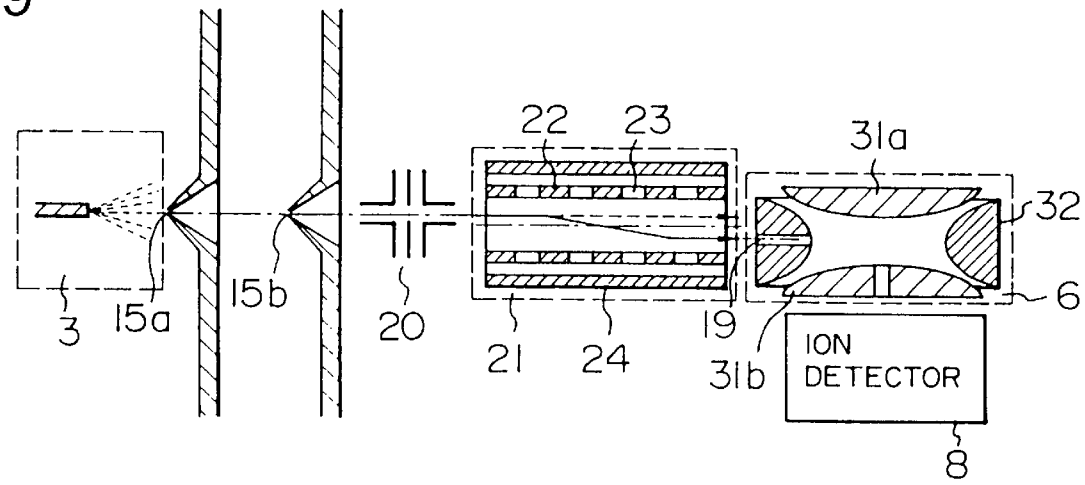

FIG. 29 shows a structure in which the ion introducing aperture 19 is provided in the ring electrode 32 in the ion trap mass spectrometer. Also in this case, the same effect as obtained by the apparatus shown in FIG. 14 can be obtained. Also in the ion trap mass analysis region, the endcap electrode or ring electrode having opening of the ion introducing aperture 19 is preferably heated by a heater or the like to reduce contamination with charged droplets or droplets without charge. In FIGS. 28 and 29, the respective center axes of the ion sampling apertures, electrostatic lens, ion introducing aperture and mass analysis region are arranged in the same manner as in the first embodiment.

A modified example of the structure shown in FIG. 28 will be described below. In the structure of FIG. 28, the respective center axes of the ion sampling apertures, electrostatic lens, ion introducing aperture and mass analysis region do not overlap each other. The same effect as obtained by the apparatus shown in FIG. 28 can be obtained by a structure in which: the center axis of the ion introducing aperture is arranged so as to be shifted from the center axis of the mass analysis region; the respective center axes of the ion sampling apertures and mass analysis region are arranged so as to be coincident with each other; and the respective center axes of the electrostatic lens, ion sampling apertures and ion introducing aperture are arranged so as to be shifted from each other.

Figure 30:
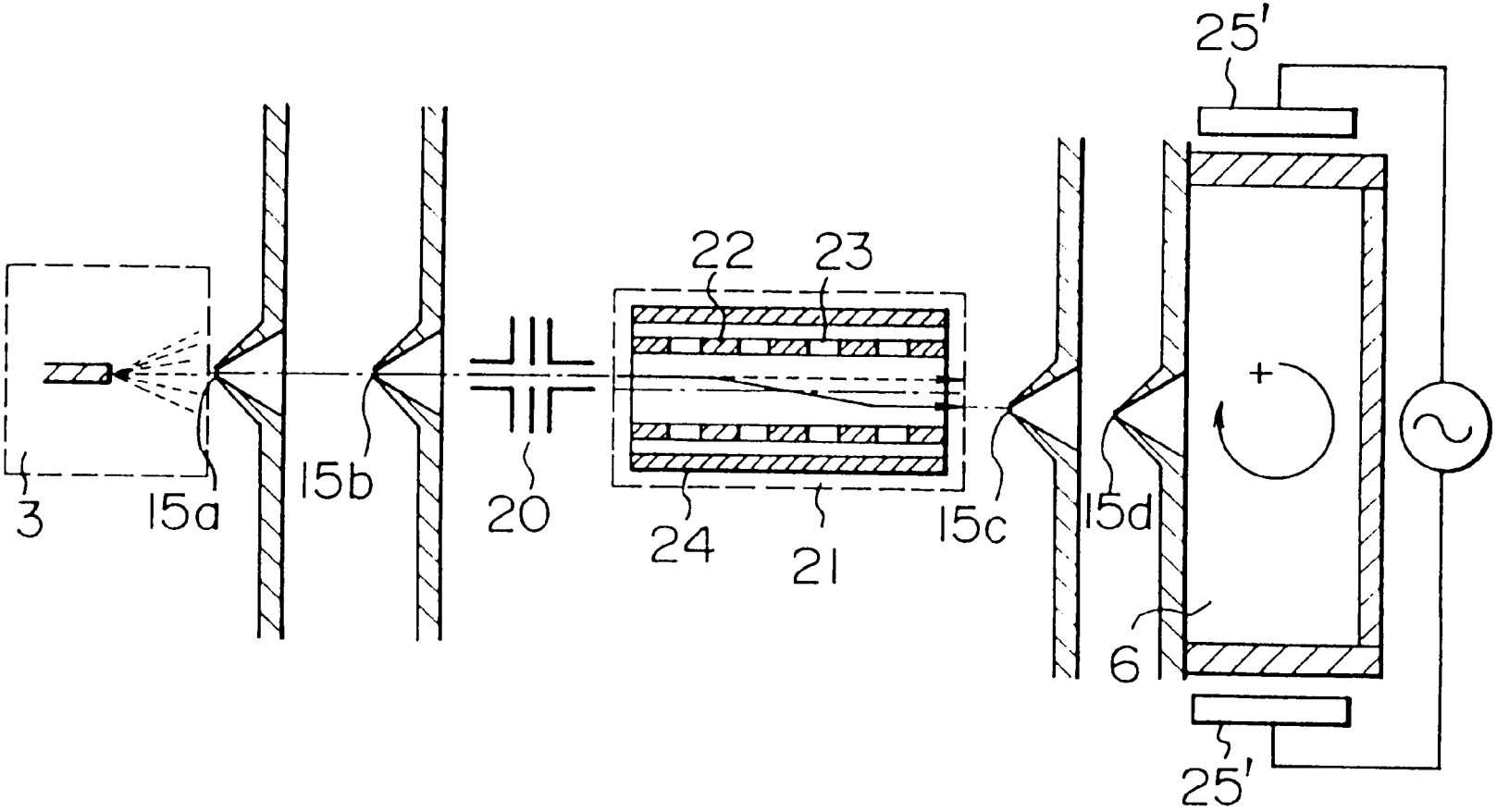
FIG. 30 is a view showing the structure of amass spectrometer having a Fourier transformation ion cyclotron resonance mass analysis region according to a ninth embodiment of the present invention.

FIG. 30 shows an example of the structure of a mass spectrometer having a Fourier transformation ion cyclotron resonance mass analysis region as the mass analysis region 6. Fourier transformation ion cyclotron resonance mass spectrometry is a method in which: ions are cyclotron-moved under very low pressure and an intensive magnetic field; the rotating frequency of the ions is detected by an electrode 25' located outside of a vacuum container; and the mass of the ions is determined by Fourier transformation of the frequency spectra thereof. This method has very high resolution but the mass analysis region requires a high degree of vacuum of from 10<−6>Pa to 10<−7> Pa. In the case where ions are introduced from atmospheric air, therefore, not only a plurality of ion sampling apertures 15*a*, 15*b*, 15*c* and 15*d* must be provided but also large-sized vacuum pumps of a high evacuating speed type must be used as vacuum systems for evacuating a space between the ion sampling apertures 15*a* and 15*b*, a space between the ion sampling apertures 15*b* and 15*c*, and a space between the ion sampling apertures 15*c* and 15*d*, respectively. The method in which ions are separated from charged droplets or droplets without charge by deflection of the ions and successively introduced into the next-stage ion sampling aperture, as shown in FIG. 30, is effective because the degree of vacuum in the mass analysis region can be prevented from being deteriorated by the inflow of the charged droplets or droplets without charge.

Figure 31:
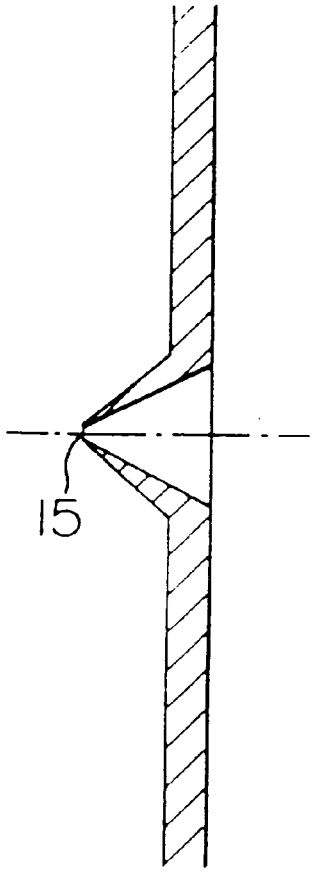
FIGS. 31 and 32 are enlarged views of ion sampling apertures, respectively.
Figure 32:
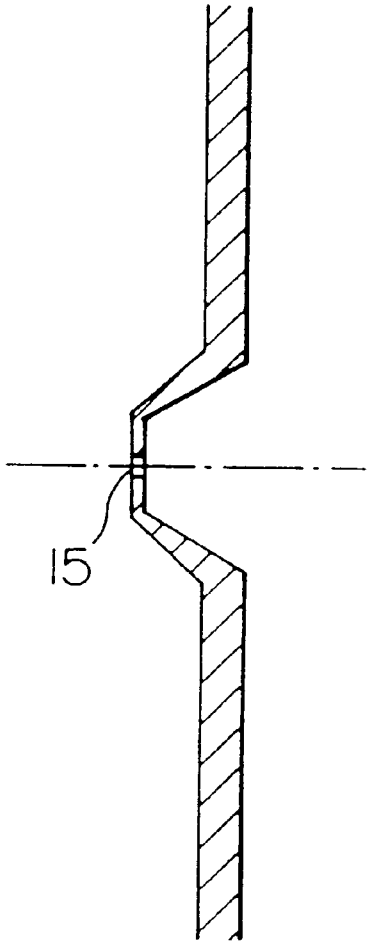

The definition of the center axis of the ion sampling aperture in the present invention will be described with care. The ion sampling aperture 15 is preferably shaped like a taper as shown in FIG. 31. Because it is difficult to process, however, a hole having a predetermined shape such as a circular shape or a square shape is generally formed on a plane at the end portion as shown in FIG. 32. In the present invention, the center axis of the ion sampling aperture means an axis which passes through the center of the hole and makes a normal line to the plane at the end portion.

According to the above embodiments of the present invention, the mass spectrometer comprises an ionization portion for generating electrically charged droplets or ions from a sample solution under atmospheric pressure or similar pressure, a differential pumping portion for introducing electrically charged droplets or ions into a mass analysis portion under a high vacuum, and a mass analysis portion for taking-in ions and performing mass analysis, detection and data processing, whereby noises are reduces greatly without reducing signals to thereby greatly improve the signal-to-noise ratio as an index of detecting sensitivity (lower limit) by combination of cutting of small droplets, neutral particles or photons through a slit provided between the differential pumping portion and the mass analysis portion, with slight deflection of ions just before introduction of ions into the mass analysis portion.

What is claimed is:

1. An ion source comprising:

an ionization region for ionizing a sample under atmospheric pressure;

an aperture for introducing ions generated in said ionization region into a vacuum region, and a ring electrode provided between said aperture and said vacuum region, said ring electrode being located so that a center axis of said ring electrode is different from an axis of the aperture.

2. An ion source comprising:

an ionization region for ionizing a sample under atmospheric pressure;

first and second apertures, located between said ionization region and a vacuum region, through which ions generated in said ionization region are introduced into said vacuum region, and a ring electrode provided between said first aperture and said second aperture, said ring electrode being located so that a center axis of said ring electrode is different from an axis of said second aperture.

3. A mass spectrometer comprising:

an ionization region for ionizing a sample under atmospheric pressure;

first and second apertures, located between said ionization region and a vacuum region, through which ions generated in said ionization region are introduced into said vacuum regions, and a region forming an electrostatic field for deflecting and focusing located between said first aperture and second aperture, wherein an axis of said first aperture is different from an axis of said second aperture.

4. A mass spectrometer comprising:

an ionization region for ionizing a sample under atmospheric pressure;

an aperture for introducing ions generated in said ionization region into a vacuum region, and a ring electrode provided between said aperture and said vacuum region, said ring electrode being located so that a center axis of said ring electrode is different from an axis of the aperture.

5. A mass spectrometer comprising:

an ionization region for ionizing a sample under atmospheric pressure;

first and second apertures, located between said ionization region and a vacuum region, through which ions generated in said ionization region are introduced into said vacuum region, and a ring electrode provided between said first aperture and said second aperture, said ring electrode being located so that a center axis of said ring electrode is different from an axis of said second aperture.

6. A mass spectrometer comprising:

an ionization region for ionizing a sample to be analyzed by said mass spectrometer;

a cylindrical electrostatic electrode arranged in a stage after said ionization region;

an aperture arranged in an another stage after said cylindrical electrostatic electrode for extracting ions of said sample; and wherein said ions of said sample from said ionization region are introduced into said cylindrical electrostatic electrode at a position deviated from an axis of said cylindrical electrostatic electrode.

7. An ion source for a sample to be analyzed by a mass spectrometer comprising:

an ionization region for ionizing a sample to be analyzed by said mass spectrometer;

a cylindrical electrostatic electrode arranged in a stage after said ionization region;

an aperture arranged in an another stage after said cylindrical electrostatic electrode for extracting ions of said sample; and wherein said ions of said sample from said ionization region are introduced into said cylindrical electrostatic electrode at a position deviated from a center axis of said cylindrical electrostatic electrode to send out said ions of said sample through said aperture.

8. A mass spectrometer comprising:

an ionization region for ionizing a sample to be analyzed by said mass spectrometer;

a cylindrical electrostatic electrode into which said ions from said ionization region are introduced;

an aperture arranged in a stage after said cylindrical electrostatic electrode for introducing said ions into a low pressure region;

a mass analysis region for mass analyzing said ions from said low pressure region;

wherein said low pressure region has a pressure lower than that of said ionization region;

wherein a region accommodating said cylindrical electrostatic electrode has a pressure between the pressure of said ionization region and the pressure of said low pressure region; and wherein said ions from said ionization region are introduced into said cylindrical electrostatic electrode at a position deviated from an axis of said cylindrical electrostatic electrode.

9. A mass spectrometer comprising:

an ionization region for ionizing a sample to be analyzed by said mass spectrometer;

a cylindrical electrostatic electrode into which said ions from said ionization region are introduced;

an aperture arranged in a stage after said cylindrical electrostatic electrode for introducing said ions into a first region; and a mass analysis region for mass analyzing said ions from said first region;

wherein said first region has a pressure lower than that of said ionization region;

wherein a region accommodating said cylindrical electrostatic electrode has a pressure between the pressure of said ionization region and the pressure of said first region;

wherein said ions of said sample are introduced into said cylindrical electrostatic electrode at a position deviated from a center axis of said cylindrical electrostatic electrode; and wherein said ions of said sample are extracted through said aperture.

10. A mass spectrometer comprising:

an ionization region for ionizing a sample to be analyzed by said mass spectrometer;

a cylindrical electrostatic electrode into which said ions from said ionization region are introduced;

an aperture arranged in a stage after said cylindrical electrostatic electrode for introducing said ions into a low pressure region; and a mass analysis region for mass analyzing said ions from said low pressure region;

wherein said low pressure region has a pressure lower than that of said ionization region;

wherein a region accommodating said cylindrical electrostatic electrode has a pressure between the pressure of said ionization region and the pressure of said low pressure region;

wherein said ions of said sample are extracted through said aperture.

11. A mass spectrometer comprising:

an ionization region for ionizing a sample to be analyzed by said mass spectrometer;

a cylindrical electrostatic electrode arranged in a stage after said ionization region; and an aperture arranged in another stage after cylindrical electrostatic electrode for extracting ions of said sample;

wherein said aperture is formed at a projected portion of a conical member projected on the side of said cylindrical electrostatic electrode and said ions are extracted through said aperture.

12. An ion source for a mass spectrometer comprising:

an ionization region for ionizing a sample to be analyzed by said mass spectrometer;

a cylindrical electrostatic electrode arranged in a stage after said ionization region; and an aperture arranged in another stage after said cylindrical electrostatic electrode for extracting ions of said sample;

wherein said ions of said sample ionized by said ionization region are introduced into said cylindrical electrostatic electrode at a position deviated from an axis of said cylindrical electrostatic electrode; and wherein said aperture is formed in a conical member projected on the side of said cylindrical electrostatic electrode and said ions are extracted through said aperture.

13. A mass spectrometer comprising:

an ionization region for ionizing a sample to be analyzed by said mass spectrometer;

a cylindrical electrostatic electrode arranged in a stage after said ionization region; and an aperture arranged in another stage after said cylindrical electrostatic electrode for extracting ions of said sample;

wherein said ions of said sample ionized by said ionization region are introduced into said cylindrical electrostatic electrode at a position deviated from a center axis of said cylindrical electrostatic electrode; and wherein said ions of said sample are extracted through said aperture; and wherein said aperture is formed in a conical member projected on the side of said electrostatic electrode.

14. A mass spectrometer comprising:

an ionization region (3) for ionizing a sample to be analyzed by said mass spectrometer;

a cylindrical electrostatic electrode (21) in a stage after said ionization region;

an aperture (25, 15C) arranged in another stage after said cylindrical electrostatic electrode for extracting ions of said sample;

a low pressure region located after said aperture; and a mass analysis region for mass analyzing ions from said low pressure region;

wherein a region accommodating said cylindrical electrostatic electrode has a pressure between the pressure of said ionization region and the pressure of said low pressure region;

wherein said ions from said ionization region are introduced into said cylindrical electrostatic electrode at a position deviated from an axis of said cylindrical electrostatic electrode;

wherein said aperture is formed in a conical member projected on the side of said electrostatic electrode.

15. An ion source of a sample to be analyzed by a mass spectrometer comprising:

an ionization region for ionizing a sample to be analyzed by said mass spectrometer;

an electrostatic electrode arranged in a stage after said ionization region; and an aperture arranged in another stage after said electrostatic electrode for extracting ions of said sample;

wherein said aperture is formed in a conical member projected on the side of said electrostatic electrode;

wherein said ions of said sample ionized by said ionization region are introduced into said electrostatic electrode at a position deviated from an center axis of said electrostatic electrode; and wherein said ions of said sample are extracted through said aperture.

16. A mass spectrometer comprising:

an ionization region for ionizing a sample to be analyzed by said mass spectrometer;

a cylindrical electrostatic electrode arranged in a stage after said ionization region;

an aperture arranged in an another stage after said cylindrical electrostatic electrode for extracting ions of said sample;

a first wall located between said ionization region and another region including said cylindrical electrostatic electrode; and a first opening formed in said first wall;

wherein said aperture has a conical member projected on the side of said cylindrical electrostatic electrode, a second opening being formed in the center portion of said conical member; and wherein an axis of said first opening is deviated from an axis of said second opening.

17. A mass spectrometer comprising:

an ionization region for ionizing a sample to be analyzed by said mass spectrometer;

a cylindrical electrostatic electrode arranged in a stage after said ionization region;

an aperture arranged in another stage after said cylindrical electrostatic electrode for extracting ions of said sample;

a first wall located between said ionization region and another region including said cylindrical electrostatic electrode, a first opening being formed in said first wall;

a low pressure region located after a region including said cylindrical electrostatic electrode and having a pressure lower than that in said region including said cylindrical electrostatic electrode; and a second wall located between said region including said cylindrical electrostatic electrode and said low pressure region;

wherein said second wall has a conical member projected on the side of said cylindrical electrostatic electrode, said conical member having a second opening formed in the center portion of said conical member; and wherein an axis of said first opening and an axis of said second opening are shifted from each other.

18. A mass spectrometer comprising:

an ionization region for ionizing a sample to be analyzed by said mass spectrometer;

a cylindrical electrostatic electrode into which samples from said ionization region is introduced at a position deviated from the center axis of said cylindrical electrostatic electrode to divide the samples into charged particles and uncharged particles; and a skimmer projected on the side of said cylindrical electrostatic electrode.

19. An ion source for a sample to be analyzed by a mass spectrometer comprising:

an ionization region for ionizing a sample to be analyzed by said mass spectrometer;

a cylindrical electrostatic electrode into which samples from said ionization region is introduced at a position deviated from the center axis of said cylindrical electrostatic electrode and in substantially parallel to said center axis to divide the samples into charged particles and uncharged particles and a skimmer projected on the side of said cylindrical electrostatic electrode.

20. A mass spectrometer comprising:

a first stage;

a second stage located after said first stage;

a third stage located after said second stage; and a fourth stage located after said third stage;

wherein a sample to be analyzed is ionized in said first stage;

wherein said second stage includes a electrostatic lens into which the sample ionized in said first stage is introduced at a position deviated from the center axis of said electrostatic lens;

wherein said third stage is kept in a low pressure and the sample from said second stage is introduced into said third stage; and wherein ions of the sample from said third stage are analyzed in said forth stage.

21. A mass spectrometer comprising:

an ionization region for ionizing a sample to be analyzed;

a lens stage located after said ionization region; and a mass analysis stage located after said lens stage;

wherein said lens stage includes a cylindrical electrode and a conical member located after said cylindrical electrode, said conical member being projected on the side of said cylindrical electrode and having an opening at the top of said conical member; and wherein samples from said ionization region are introduced into said cylindrical electrode at a position deviated from the center axis of said cylindrical electrode and the sample passing through said cylindrical electrode passing through said opening of said conical member to introduce into said analysis stage.

22. A mass spectrometer comprising:

an ionization region for ionizing a sample to be analyzed;

a lens stage located after said ionization region; and cylindrical electrode located after said ionization region;

a conical member located after said cylindrical electrode and projected on the side of said electrode and said conical member having an opening in the top thereof; and a mass analysis region located after said conical member;

wherein samples from said ionization region are introduced into said cylindrical electrode at a position deviated from the center axis of said cylindrical electrode and in substantially parallel to said center axis; and wherein the sample passing through said cylindrical electrode passes through said opening of said conical member to introduce into aid mass analysis region.

23. A mass spectrometer according to claim 22, wherein said opening of said conical member is positioned on a center axis of said conical member and wherein an axis along which the sample is introduced into said electrode is in parallel to an axis of said conical member.

* * * * *

UNITED STATES PATENT AND TRADEMARK OFFICE

CERTIFICATE OF CORRECTION

PATENT NO. : 6,005,245
DATED : December 21, 1999
INVENTOR(S) : Minoru Sakairi et al.

It is certified that error appears in the above-identified patent and that said Letters Patent is hereby corrected as shown below:

Column 1,
Line 22, after "related" insert -- art --.
Line 46, change "noises" to -- noise --.
Line 58, change "remain inevitably" to -- inevitably remain --.
Line 61, change "bit noises" to -- big noise --.
Line 65, change "focuses" to -- focused --.

Column 2,
Line 24, change "increases" to -- increased --.

Column 5,
Line 19, change "amass" to -- a mass --.
Line 31-32, delete "which is a kind of atmospheric pressure ionizing method".
Line 48, change "an nebulizer" to -- a nebulizer --.

Column 6,
Line 62, change "there is no meaning of the slit" to -- the slit has no effect --.

Column 8,
Line 2, delete "of".
Line 16, change "meaning" to -- feature --.
Line 39, delete "observed".
Line 44, after "noises" delete "of".
Line 51, change "defection" to -- deflection --.
Line 58, after "Furthermore," change "the" to -- there is little --.
Line 59, delete "is little observed".

Column 9,
Line 42, change "form" to -- from --.
Line 53, change "position. As" to -- positions. The --.

Column 11,
Line 39, change "are thought of" to -- are considered --.

Column 12,
Line 55, delete "nearly".

UNITED STATES PATENT AND TRADEMARK OFFICE

CERTIFICATE OF CORRECTION

PATENT NO. : 6,005,245
DATED : December 21, 1999
INVENTOR(S) : Minoru Sakairi et al.

It is certified that error appears in the above-identified patent and that said Letters Patent is hereby corrected as shown below:

Column 20,
Line 34, change "region is" to -- region are --.
Line 46, change "region is" to -- region are --.

Column 22,
Line 10, after "and" delete "in".
Line 14, change "aid" to -- said --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*